US005548308A

United States Patent [19]

Nagatomo et al.

[11] Patent Number: 5,548,308

[45] Date of Patent: Aug. 20, 1996

[54] LIQUID DISCHARGE RECORDING APPARATUS HAVING APPARATUS FOR EFFECTING PREPARATORY EMISSION

[75] Inventors: Akira Nagatomo, Yokohama; Yoshifumi Hattori, Yamato; Isao Ebisawa, Tokyo; Tsutomu Abe, Isehara; Takashi Ohba, Atsugi; Hiroshi Iida, Machida; Kenjiro Watanabe, Atsugi, all of Japan

[73] Assignee: Canon Kabushiki Kaisha, Tokyo, Japan

[21] Appl. No.: 389,747

[22] Filed: Feb. 14, 1995

Related U.S. Application Data

[63] Continuation of Ser. No. 223,129, Apr. 5, 1994, abandoned, which is a continuation of Ser. No. 905,111, Jun. 26, 1992, abandoned, which is a division of Ser. No. 746,217, Aug. 16, 1991, abandoned, which is a continuation of Ser. No. 603,252, Oct. 25, 1990, abandoned, which is a continuation of Ser. No. 455,765, Dec. 28, 1989, abandoned, which is a continuation of Ser. No. 332,385, Apr. 3, 1989, abandoned, which is a continuation of Ser. No. 136,441, Dec. 17, 1987, abandoned, which is a continuation of Ser. No. 809,774, Dec. 17, 1985, abandoned.

[30] Foreign Application Priority Data

| | | | |
|---|---|---|---|
| Dec. 21, 1984 | [JP] | Japan | 59-268601 |
| Dec. 21, 1984 | [JP] | Japan | 59-268602 |
| Dec. 21, 1984 | [JP] | Japan | 59-268603 |
| Dec. 21, 1984 | [JP] | Japan | 59-268604 |
| Dec. 21, 1984 | [JP] | Japan | 59-268605 |
| Dec. 21, 1984 | [JP] | Japan | 59-268606 |
| Dec. 21, 1984 | [JP] | Japan | 59-268607 |
| Dec. 21, 1984 | [JP] | Japan | 59-268608 |
| Dec. 21, 1984 | [JP] | Japan | 59-268609 |
| Dec. 21, 1984 | [JP] | Japan | 59-268610 |
| Dec. 21, 1984 | [JP] | Japan | 59-268612 |
| Dec. 21, 1984 | [JP] | Japan | 59-268613 |
| Dec. 21, 1984 | [JP] | Japan | 59-268615 |

[51] Int. Cl.[6] ..... B41J 2/05; B41J 2/165

[52] U.S. Cl. ..... 347/9; 347/35; 347/60

[58] Field of Search ..... 347/5, 9, 14, 17, 347/23, 35, 60

[56] References Cited

U.S. PATENT DOCUMENTS 3,925,788 12/1975 Kashio .
3,925,789 12/1975 Kashio .

(List continued on next page.)

FOREIGN PATENT DOCUMENTS 2260775 6/1973 Germany .
2943164 5/1980 Germany .

(List continued on next page.)

*Primary Examiner*—Joseph W. Hartary
*Attorney, Agent, or Firm*—Fitzpatrick, Cella, Harper & Scinto

[57] ABSTRACT

A liquid-discharge recording apparatus such as an ink-jet printer comprises: a liquid-discharge recording unit having an emission energy generating device including an electro-thermal energy converting device which can heat a recording liquid such as an ink to form liquid droplets in response to an electrical signal, in which this recording unit emits the liquid droplets and deposits them on a recording paper and thereby recording thereon; a recording unit control circuit which can set and supplies the electrical signal to form the liquid droplets to the emission energy generating device in response to a recording signal; and an emission controller for setting the electrical signal to form the liquid droplets to the recording unit control circuit when a power supply is turned on, thereby allowing the recording unit to and emit the liquid droplets in accordance with an environmental condition such as a temperature of the recording liquid. With this dedicated emission controller, the proper emission condition is set and preheating processes and preliminary emitting processes are executed prior to starting the printing after the turn-on of the power supply of the printer, so that the printing state can be promptly and easily optimized by a simple software.

19 Claims, 24 Drawing Sheets

U.S. PATENT DOCUMENTS

| | | | |
|---|---|---|---|
| 3,971,039 | 7/1976 | Takano et al. . | |
| 4,176,363 | 11/1979 | Kasahara . | |
| 4,296,421 | 10/1981 | Hara . | |
| 4,376,945 | 3/1983 | Hara et al. . | |
| 4,393,386 | 7/1983 | DiGiulio | 347/5 X |
| 4,463,359 | 7/1984 | Ayata | 347/60 X |
| 4,466,005 | 8/1984 | Yoshimura . | |
| 4,558,326 | 12/1985 | Kimura et al. | 346/140 X |
| 4,587,535 | 5/1986 | Watanabe . | |
| 4,609,925 | 9/1986 | Nozu | 346/140 X |
| 4,668,965 | 5/1987 | Tanaka . | |
| 4,692,777 | 9/1987 | Hasumi . | |
| 4,707,705 | 11/1987 | Hara et al. . | |
| 4,712,172 | 12/1987 | Kiyohara et al. . | |
| 4,719,472 | 1/1988 | Arakaua | 347/67 |

FOREIGN PATENT DOCUMENTS

| | | | |
|---|---|---|---|
| 3247540 | 7/1983 | Germany | B41J 3/04 |
| 3332273 | 3/1984 | Germany | B41J 3/04 |
| 3417886 | 11/1984 | Germany | B41J 3/04 |
| 53-097837 | 8/1978 | Japan . | |
| 58-187364 | 11/1983 | Japan . | |
| 58-220757 | 12/1983 | Japan . | |
| 59-162802 | 8/1984 | Japan . | |
| 59-209877 | 11/1984 | Japan | B41J 3/04 |
| 2159465 | 12/1985 | United Kingdom . | |

LIQUID-DISCHARGE RECORDING UNIT
HU
HEATER
HTR
TEMPERATURE SENSOR
TS
DRIVER
11
HEAD-UNIT CONTROLLER
10
PROTECTIVE CIRCUIT
13
DRIVER
14
TEMP-COMPARING ELEMENT
15
FONT SWITCH
16
INPUT SELECTOR
17
DRIVER
18
DRIVER
21
DRIVER
22
DRIVER
24
M3
MV
20
M1
M2
MPU
2
CAP-MODE SENSOR
8
PAPER SENSOR
9

| |
|---|
| Fig.17A-1 |
| Fig.17A-2 |
| Fig.17A-3 |

LIQUID DISCHARGE RECORDING APPARATUS HAVING APPARATUS FOR EFFECTING PREPARATORY EMISSION

This application is a continuation of application Ser. No. 08/223,129 filed Apr. 5, 1994, now abandoned, which is a continuation of application Ser. No. 07/905,111 filed Jun. 26, 1992, abandoned, which is a division of application Ser. No. 07/746,217 filed Aug. 16, 1991, abandoned, which is a continuation of application Ser. No. 07/603,252 filed Oct. 25, 1990, abandoned, which is a continuation of application Ser. No. 07/455,765 filed Dec. 28, 1989, abandoned, which is a continuation of application Ser. No. 07/332,385 filed Apr. 3, 1989, abandoned, which is a continuation of application Ser. No. 07/136,441 filed Dec. 17, 1987, abandoned, which is a continuation of application Ser. No. 06/809,774 filed Dec. 17, 1985, abandoned.

BACKGROUND OF THE INVENTION

1. Field of the Invention

The present invention relates to a liquid-discharge recording apparatus in which a liquid is emitted as liquid droplets and these droplets are deposited on a recorded material such as a paper or the like the to perform recording and, more particularly, to a liquid-discharge recording apparatus in which an emission energy is given to the liquid to form flight liquid droplets.

2. Description of the Prior Art

A liquid-discharge recording method (ink-jet recording method) is a recording method whereby liquid droplets of a recording liquid are formed by various methods and these droplets are deposited on a recorded material such as a paper or the like thereby to perform the recording.

Among recording apparatuses (printers) to which such a recording method is applied, as an apparatus having a structure suitable for constituting a high-density multiorifice of the recording head, a liquid-discharge recording apparatus of the type using the heat as an energy to form emission liquid droplets (hereinafter, referred to as an ink-jet printer) can be mentioned.

Such an ink-jet printer of the type using heat as the liquid droplet emission energy generally comprises liquid droplet forming means and a recording head. Namely, the liquid droplet forming means heats the recording liquid and causes the deformation of the recording liquid accompanied with a rapid increase in volume and allows the recording liquid to be emitted from an orifice (liquid droplet emission hole) of the nozzle portion, thereby forming liquid droplets of the recording liquid. The recording head has an electrothermal energy converting device (hereinafter referred to as an emitting heater) which can generate heat to heat the recording liquid in response to an electrical signal.

On one hand, as a recording liquid which is used to record by the ink-jet printer, a water-base recording liquid is mainly used in consideration of the recording characteristic, safety, and the like. This water-base recording liquid is generally formed from the recording material component such as a pigment, dye, or the like and the water or solvent component mainly consisting of water and water soluble organic solvent in order to dissolve or disperse the recording material component.

In the foregoing printer using the heat as the liquid droplet emission energy and printers to which other liquid droplet forming methods are applied, in many cases, the orifice formed at the end of the nozzle from which the recording liquid is emitted is always open to the outside of the apparatus irrespective of whether the apparatus is driven or not.

Therefore, in the case where the apparatus is not used for recording for a long time, the solvent component of the liquid, such as, for example, water, volatile organic solvent, or the like is evaporated from the orifice into the open air from the recording liquid remaining in the orifice, and the portions near the orifice, since a water-base liquid or other solvent is used in the recording liquid as mentioned above. Thus, the recording material component and the unvolatilizable solvent component remain in the recording liquid, causing a viscosity of the recording liquid remaining in this portion to increase. Since the viscosity of the recording liquid exceeds a range suitable for emission of the recording liquid, there are problems such that immediately after the recording was restarted, in spite of the fact that an emitting signal is applied, a defective emission of liquid droplets in which no liquid droplet is emitted is likely to occur and a failure occurs in an initial printing section or the like of a recording image.

On one hand, although there have been proposed the printers in which the emission surface where the orifice is formed is capped when the apparatus is not used such as in the case where the power supply is off or the like, even if the emission surface is capped, the orifice is not perfectly shut out from the open air. Therefore, the foregoing problems are caused even in this kind of printers.

On the other hand, in Japanese Patent Unexamined Publication No. 187364/1983, there has been proposed the recording method whereby even when the liquid droplet emitting signal is not applied, an electrical signal of such a level that no recording liquid droplet is emitted is always applied to the emitting heater thereby to preheat the recording liquid in a manner such that a temperature of the recording liquid can always be maintained at a value within a predetermined range in order to obtain a good emitting state of liquid droplets for an increase in viscosity of the recording liquid at low temperatures.

Even in the printer to which the above method is applied, however, since the electrical signal is applied to the emitting heater so that the recording liquid is always maintained at high temperatures even during a relatively long interruption or stop interval of the recording operation as well, the solvent component in the recording liquid can be more easily evaporated, so that there is a problem such that the defective liquid droplet emission is further likely to occur at the restart of the recording as mentioned above. In addition, according to this method, since the peripheral portion of the emitting heater is always heated, the following problems are caused. Namely, durability of the peripheral members of the emitting heater is lost. Physical properties of the recording liquid remaining in the peripheral portion of the emitting heater change due to the heat thereof while the recording is interrupted, so that the color of the recording liquid changes or a precipitate is produced in the recording liquid and the orifice is choked, causing defective liquid droplet emission or the like.

In addition, just after the power supply of the printer was turned on, a temperature of the ink liquid regarding the recording depends on the environmental conditions such as ambient temperature and the like. Therefore, it is undesirable to start the recording by emitting the ink immediately after the turn-on of the power supply for the purpose of obtaining the stable printing state.

Therefore, it is considered to constitute the ink-jet printer in a manner such that the preliminary emission is performed before the start of the printing operation after the turn-on of the power supply and the old ink remaining in the head portion of the nozzle is preliminarily discharged and thereby optimizing the emission of the ink.

However, hitherto, the print output is carried out through an IC for a port from a microprocessing unit (MPU) for controlling each section of the printer. Therefore, according to the conventional constitution, it is extremely difficult to finely control such preliminary emission due to a problem of the processing time of the software, so that there is a problem such that the optimum preliminary emission cannot be performed.

SUMMARY OF THE INVENTION

It is an object of the present invention to solve such conventional problems and provide an ink-jet printer in which a dedicated controller is provided to control the emission of the heat unit and the preliminary heating and emitting processes are performed using this controller at the actuation of the printer or at the start of the printing, thereby enabling the printing state to be promptly and easily optimized.

Another object of the invention is to solve the foregoing conventional problems and provide an ink-jet printer in which the heating process is performed in conjunction with the printing operation when the environmental conditions are improper for recording, and further in the case where the next printing signal is not supplied within a predetermined period of time, the heating process is stopped and the head unit is capped, thereby preventing the evaporation of the ink and enabling the printing state to be kept in the optimum state.

Still another object of the invention is to solve the foregoing conventional problem and provide an ink-jet printer in which a dedicated controller is provided to control the emission of the head unit and a proper preliminary heating process in consideration of the environmental conditions is performed using this controller at the actuation of the printer or at the start of the printing operation, thereby enabling the printing state to be promptly and easily optimized.

Still another object of the invention is to provide a cheap apparatus in which the process to heat the recording liquid is executed when the recording head unit does not perform the recording operation, namely, the carriage driving means is stopped, thereby reducing an electric power consumption of the whole apparatus and decreasing the size of the power supply, wherein the good and stable liquid droplet emitting state is always obtained even in the case of the printing under circumstances at low temperatures or at the restart of the recording after an expiration of a long interruption or stop time of the recording operation.

Still another object of the invention is to provide an ink-jet printer in which the frequency is properly set subsequent to the preliminary heating process at the actuation of the printer or at the start of the printing and then the preliminary emitting process is carried out, thereby enabling the printing state to be promptly and certainly optimized.

BRIEF DESCRIPTION OF THE DRAWINGS

FIGS. 17A, 17A-1, 17A-2, 17A-3 and 17B are flowcharts showing an example of the printing state optimizing process procedure;

Figure 1:
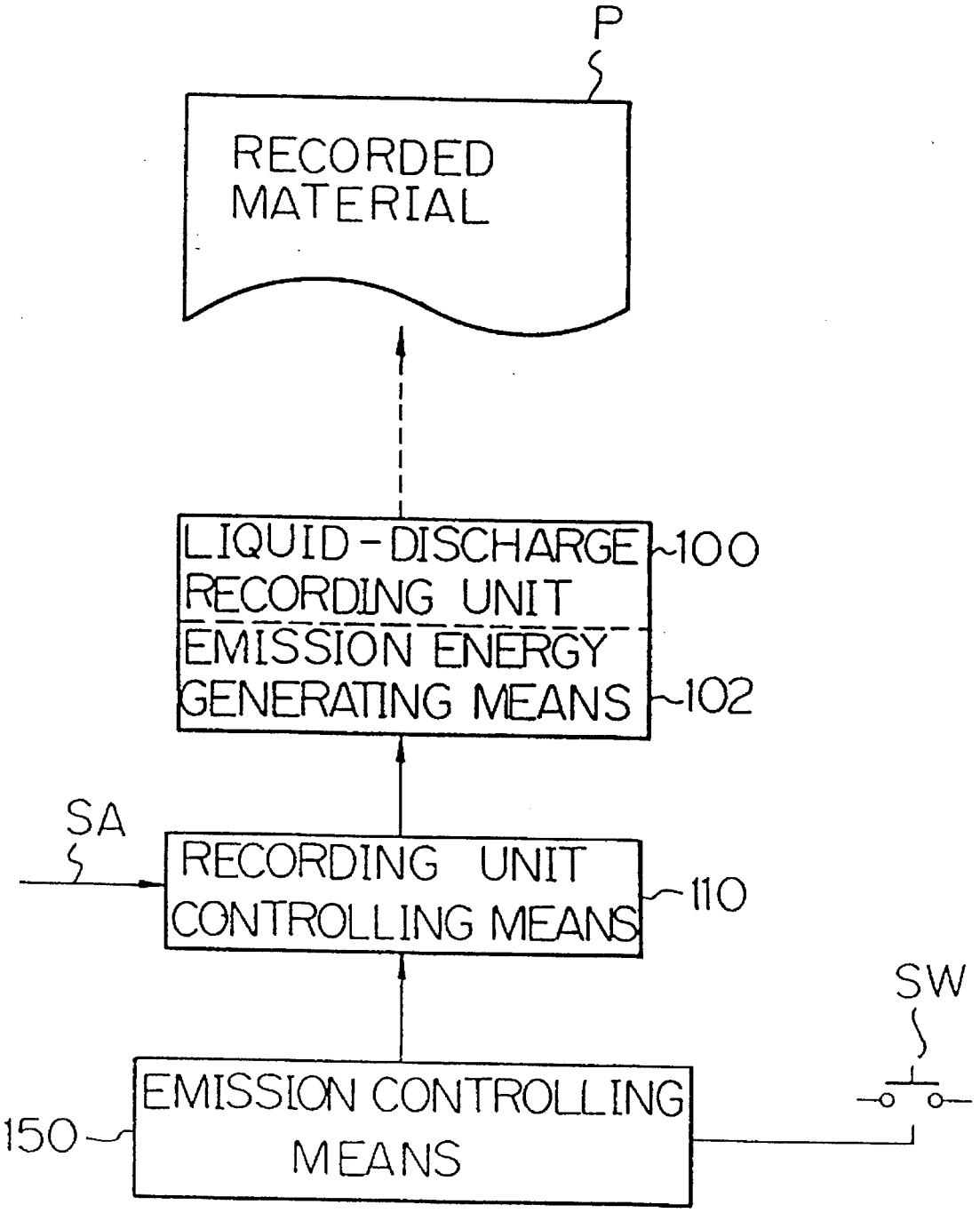
FIG. 1 is a diagram schematically illustrating a liquid-discharge recording apparatus having emission controlling means according to the present invention.

Reference characters are used in the drawings in accordance with the following:

HU . . . Liquid-discharge recording unit (head unit),
C . . . Carriage,
R . . . Guide rail,
$TB_1$, $TB_2$ . . . Supply tubes,
FC . . . Flexible cable,
ST . . . Sub-tank,
CAP . . . Cap member,
P . . . Recorded material,
PL . . . Platen,
S . . . Carriage running direction,
f . . . Conveying direction of the recorded material,
H . . . Home position,
NZ . . . Nozzle unit,
FP . . . Front plate,
IR . . . Liquid chamber,
ICH . . . Ink channel,
OR . . . Orifice,
TS . . . Temperature sensor,
HTR . . . External heater,
ET . . . Emitting heater,
$M_1$, $M_2$, $M_3$ . . . Motors,
1 . . . Programmable peripheral interface (PPI) ,
2 . . . Microprocessing unit (MPU),
3 . . . Line buffer RAM,
4 . . . Font generating ROM,
5 . . . Control ROM,
6 . . . Console,
7 . . . Home position sensor,
8 . . . Cap mode switch,
9 . . . Paper sensor,
10 . . . Head unit controller,
11, 14, 18, 21, 22, 24 . . . Drivers,
13 . . . Protective circuit,
15 . . . Temperature comparing device,
16 . . . Font switch,
17 . . . Input selector.

DETAILED DESCRIPTION OF THE PREFERRED EMBODIMENTS

FIGS. 1 to 13 show diagrammatical arrangement views showing whole arrangements of liquid-discharge recording apparatuses by which the objects of the present invention are accomplished, respectively.

The liquid-discharge recording apparatus of the first example shown in FIG. 1 comprises a liquid-discharge recording unit 100, recording unit controlling means 110, and emission controlling means 150. The recording unit 100 has emission energy generating means 102 which can allow energy to act on the liquid to form liquid droplets in response to an electrical signal. This recording unit emits the liquid droplets and allows them to be deposited on a recorded material P, thereby performing the recording. The controlling means 110 can set the electrical signal and supplies the electrical signal to form the liquid droplets to the emission energy generating means 102 in response to the input of a recording signal SA. The controlling means 150 sets the electrical signal to form the liquid droplets to the recording unit controlling means 110 when the power supply is turned on, thereby allowing the recording unit 100 to emit the liquid droplets.

Figure 2:
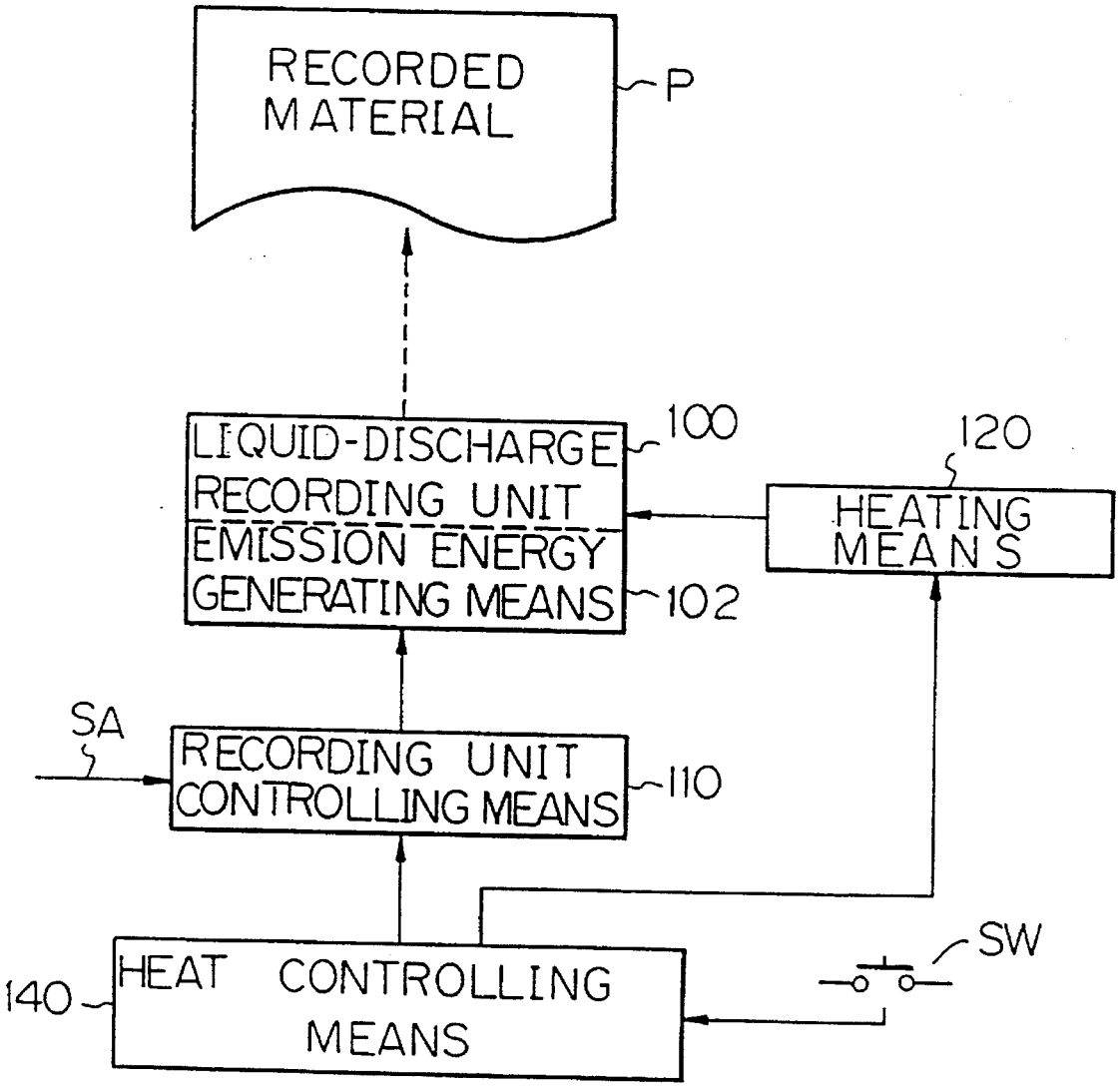
FIG. 2 is a diagram schematically illustrating a liquid discharge recording apparatus having heat controlling means and heating means in accordance with the present invention.

The liquid-discharge recording apparatus of the second example shown in FIG. 2 comprises the liquid-discharge recording unit 100, recording unit controlling means 110, heating means 120, and heat controlling means 140. The recording unit 100 has the emission energy generating means 102 including an electrothermal energy converting device which can heat the liquid to form liquid droplets in response to an electrical signal. This recording unit emits these liquid droplets and allows them to be deposited on the recorded material P, thereby performing the recording. The controlling means 110 can set the electrical signal and supplies the electrical signal to form the liquid droplets to the emission energy generating means 102 in response to the input of the recording signal SA. The heating means 120 is provided in the recording unit 100 and heats the liquid from the outside. The heat controlling means 140 allows the heating means 120 to heat the liquid and/or sets an electrical signal within a range such as not to form any liquid droplet to the recording unit controlling means 110 and thereby to heat the liquid in accordance with the environmental conditions when a power supply SW is turned on.

Figure 3:
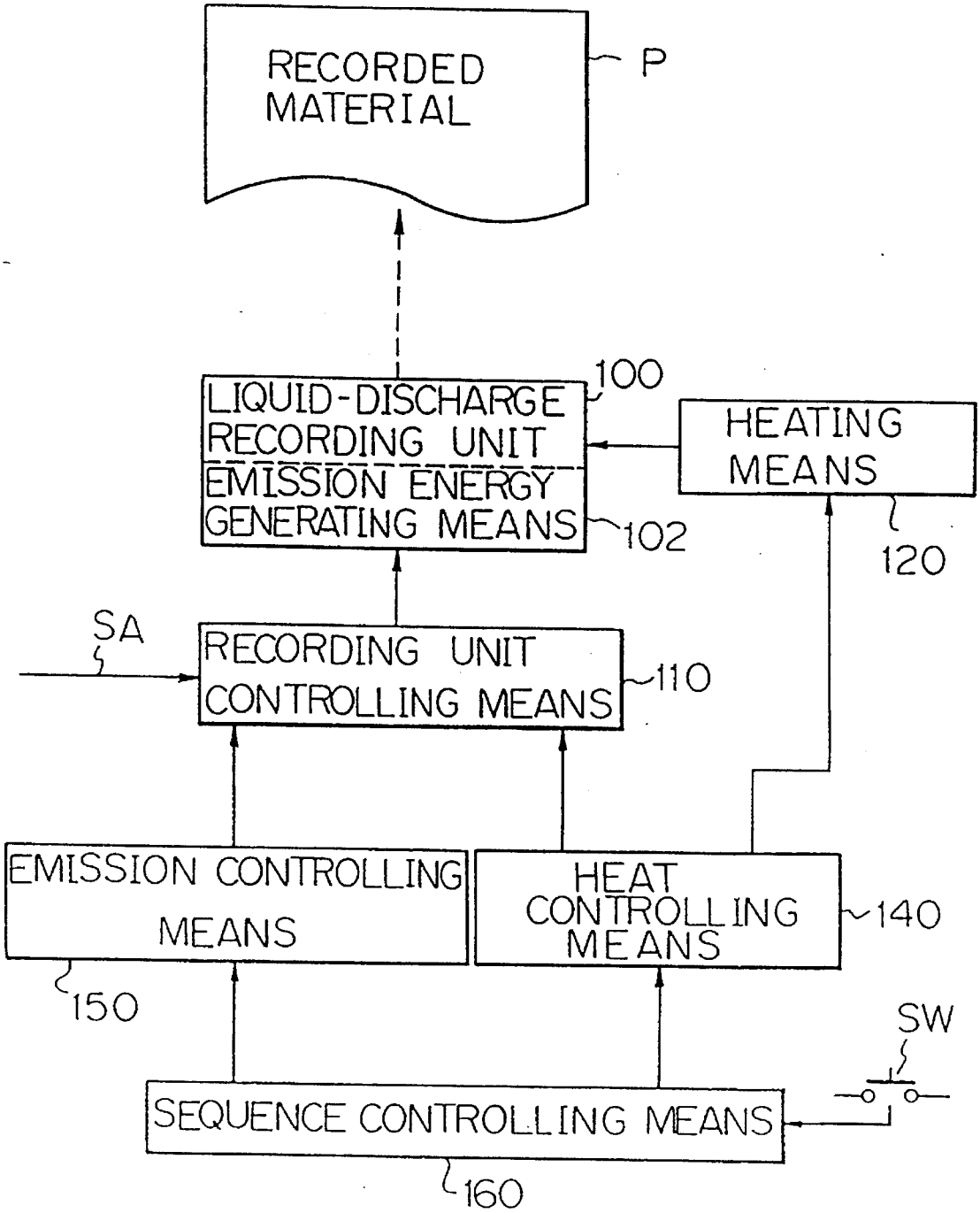
FIG. 3 is a diagram schematically illustrating a liquid discharge recording apparatus having sequence controlling means in accordance with the present invention.

The liquid-discharge recording apparatus of the third example shown in FIG. 3 comprises the liquid-discharge recording unit 100, recording unit controlling means 110, heating means 120, heat controlling means 140, emission controlling means 150, and sequence controlling means 160. The recording unit 100 has the emission energy generating means 102 including an electrothermal energy converting device which can heat the liquid in response to an electrical signal to form liquid droplets. This recording unit emits the liquid droplets and allows them to be deposited on the recorded material P, thereby performing the recording. The recording unit controlling means 110 can set the electrical signal and supplies the electrical signal to form the liquid droplets to the emission energy generating means 102 in response to the input of the recording signal SA. The heating means 120 is provided in the recording unit 100 and heats the liquid from the outside. The heat controlling means 140 allows the heating means 120 to heat the liquid and/or sets an electrical signal within a range such as not to form any liquid droplet to the recording unit controlling means 110 and thereby to heat the liquid in accordance with the environmental conditions. The emission controlling means 150 sets an electrical signal to form the liquid droplets to the controlling means 110, thereby allowing the recording unit 100 to emit the liquid droplets. The sequence controlling means 160 drives the heat controlling means 140 when the power supply SW is turned on and then drives the emission controlling means 150.

Figure 4:
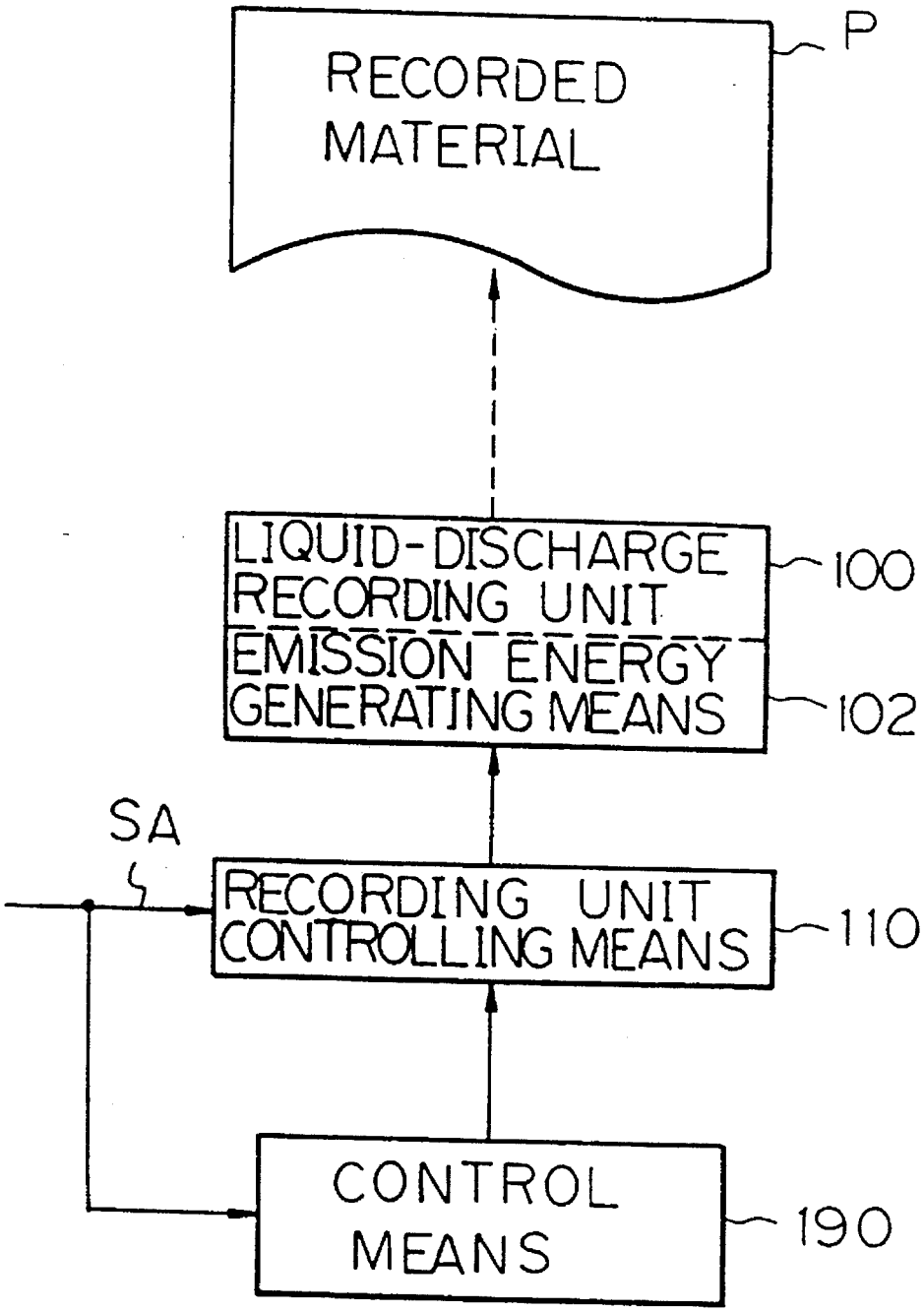
FIG. 4 is a diagram schematically illustrating a liquid discharge recording apparatus having control means in accordance with the present invention.

The liquid-discharge recording apparatus of the fourth example shown in FIG. 4 comprises the liquid-discharge recording unit 100, recording unit controlling means 110, and control means 190. The recording unit 100 has the emission energy generating means 102 which can allow energy to act on the liquid to form liquid droplets in response to the supply of an electrical signal. This recording unit emits these liquid droplets and allows them to be deposited on the recorded material P. The recording unit controlling means 110 can set the electrical signal and supplies the electrical signal to form the liquid droplets to the emission energy generating means 102 in response to the input of the recording signal SA. The control means 190 sets the electrical signal to form the liquid droplets to the recording unit controlling means 110 in response to the input of the recording signal SA in the case where the environmental conditions are proper for recording, thereby allowing the recording unit 100 to preliminarily emit the liquid droplets, and then generates a command signal.

Figure 5:
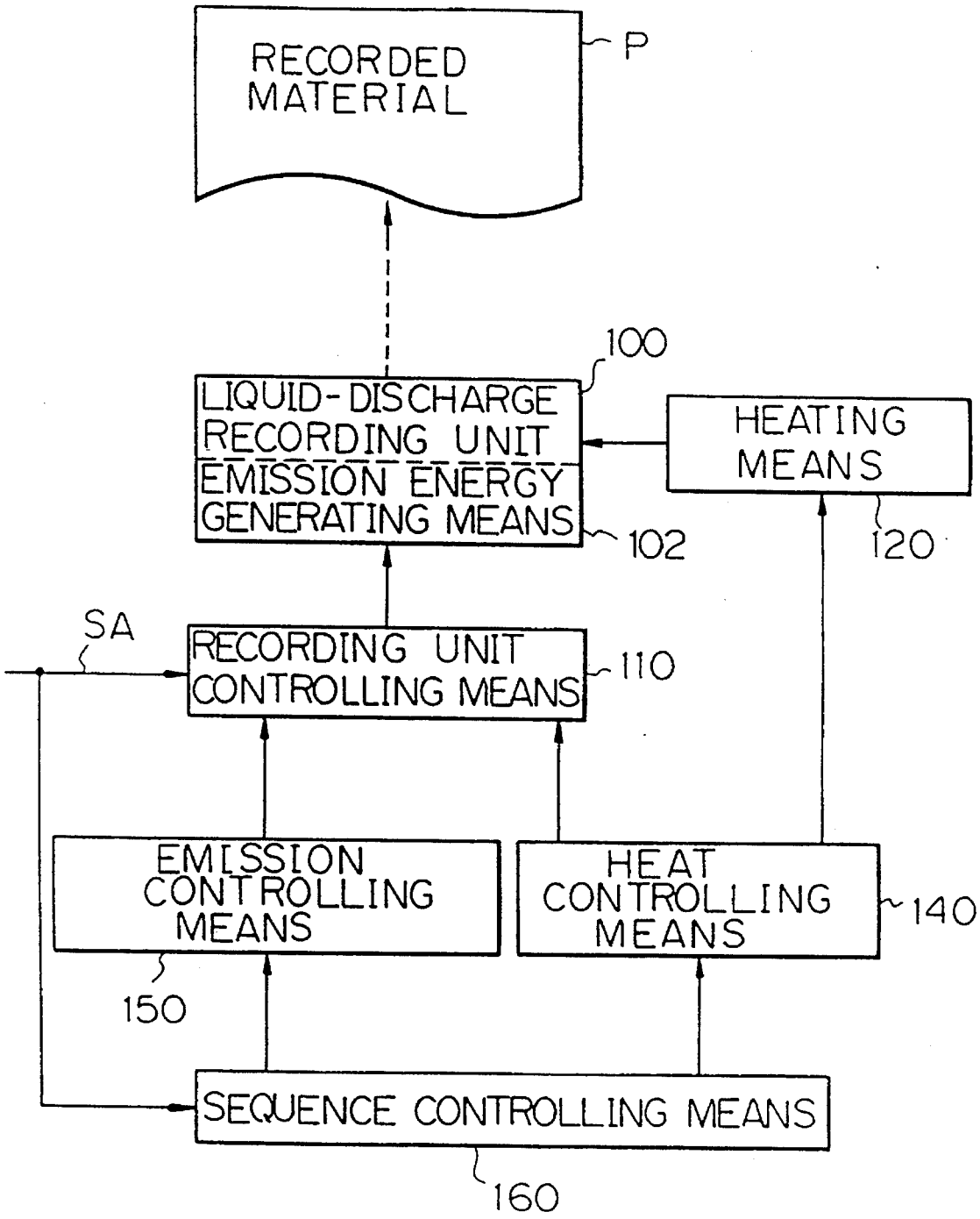
FIG. 5 is a diagram schematically illustrating a liquid discharge recording apparatus having emission controlling means, heat controlling means, sequence controlling means and heating means in accordance with the present invention.

The liquid-discharge recording apparatus of the fifth example shown in FIG. 5 comprises the liquid-discharge recording unit 100, recording unit controlling means 110, heating means 120, heat controlling means 140, emission controlling means 150, and sequence controlling means 160. The recording unit 100 has the emission energy generating means 102 including an electrothermal energy converting device which can heat the liquid to form liquid droplets in response to the supply of an electrical signal. This recording unit emits these liquid droplets and records on the recorded material P. The recording unit controlling means 110 can set the electrical signal and supplies the electrical signal to form the liquid droplets to the emission energy generating means 102 in response to a command signal to start the recording in response to the input of the recording signal SA. The heating means 120 is provided in the recording unit 100 and heats the liquid from the outside. The heat controlling means 140 allows the heating means 120 to heat the liquid and/or sets an electrical signal within a range such as not to form any liquid droplet to the recording unit controlling means 110 and thereby to heat the liquid in accordance with environmental conditions. The emission controlling means 150 sets the electrical signal to form the liquid droplets to the recording unit controlling means 110, thereby allowing the recording unit 100 to emit the liquid droplets. The sequence controlling means 160 drives the heat controlling means 140 in response to the input of the recording signal and drives the emission controlling means 150, then generates a command signal.

Figure 6:
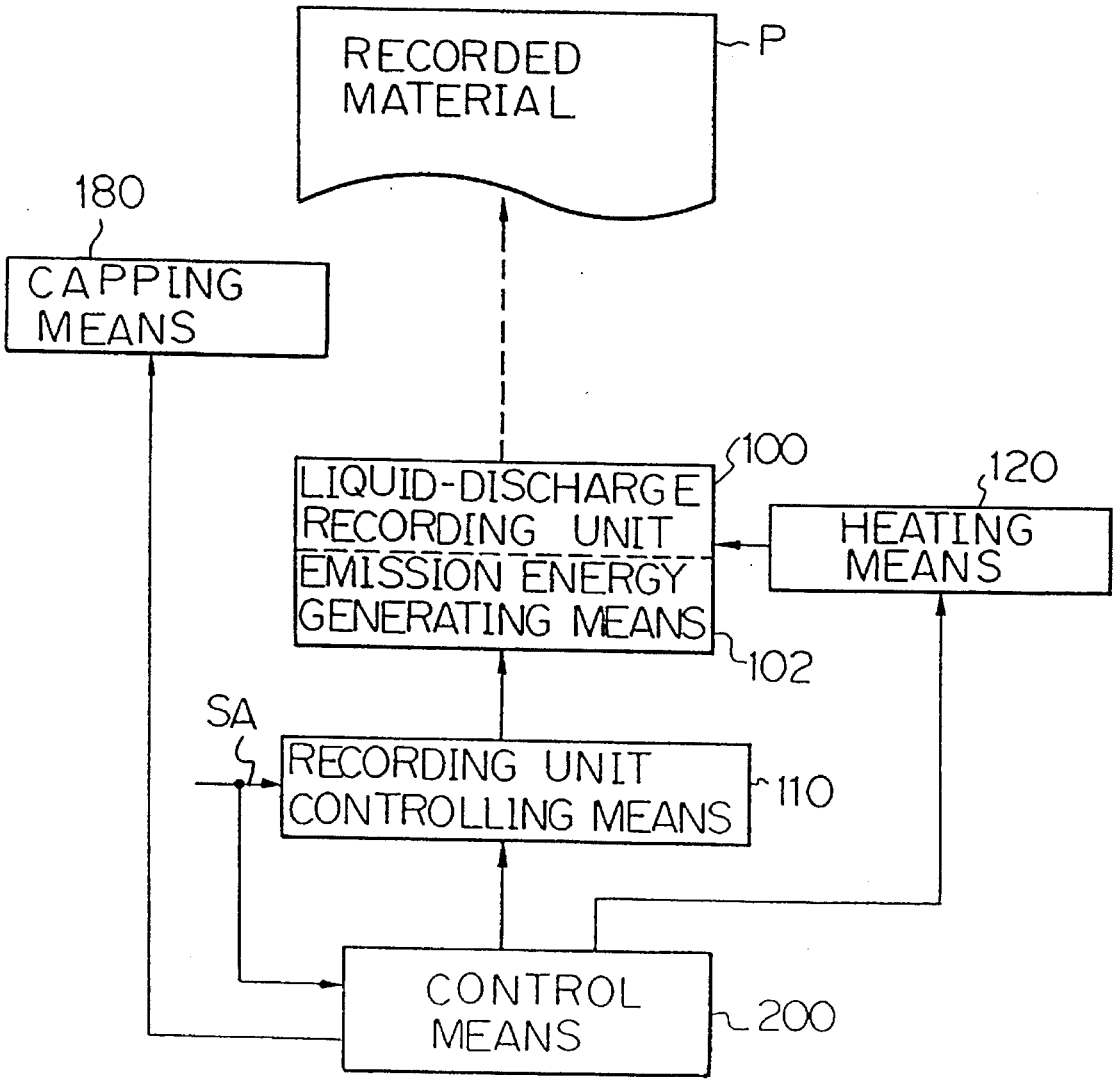
FIG. 6 is a diagram schematically illustrating a liquid discharge recording apparats having capping means in accordance with the present invention.

The liquid-discharge recording apparatus of the sixth example shown in FIG. 6 comprises the liquid-discharge recording unit 100, recording unit controlling means 110, heating means 120, capping means 180, and control means 200. The recording unit 100 has the emission energy generating means 102 which can allow an emission energy to act on the liquid to form liquid droplets in response to the supply of an electrical signal. This recording unit emits these liquid droplets, thereby recording on the recorded material P. The recording unit controlling means 110 supplies the electrical signal to form the liquid droplets to the emission energy generating means 102 in response to the input of the recording signal SA. The heating means 120 is provided in the recording unit 100 and heats the liquid from the outside. The capping means 180 can be coupled with the recording unit 100. The control means 200 instructs a heating process to the heating means 120 when the environmental conditions are improper for a recording process in conjunction with a single recording process by the recording unit 100. When the next recording signal is inputted even after an expiration of a set time after completion of the single recording process, the control means 200 instructs the stop of heating to the heating means 120 and at the same time drives the capping means 180, thereby coupling the capping means 180 with the recording unit 100.

Figure 7:
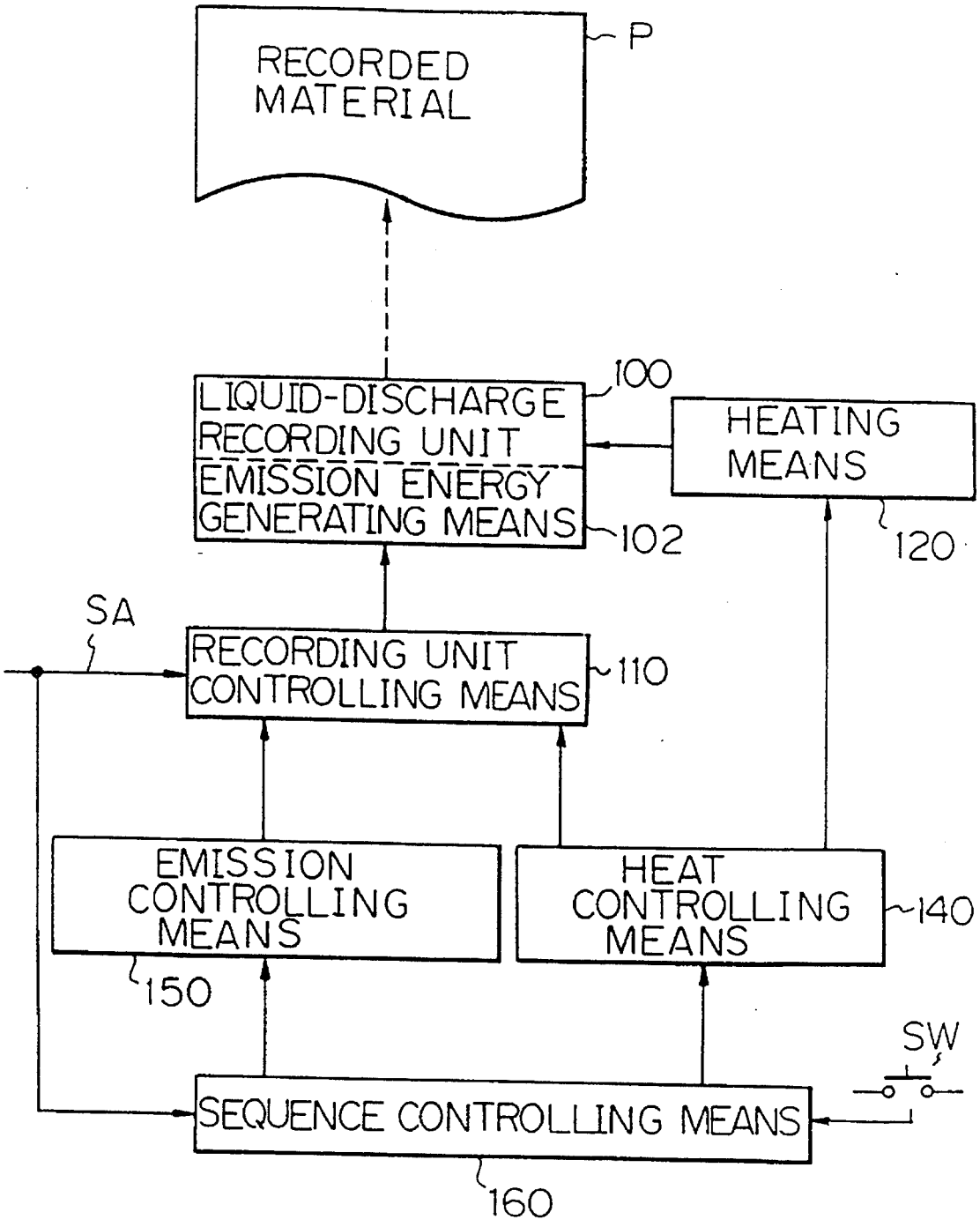
FIG. 7 is a diagram schematically illustrating a liquid discharge recording apparatus having sequence controlling means responsive to a recording signal in accordance with the present invention.

The liquid-discharge recording apparatus of the seventh example shown in FIG. 7 comprises the liquid-discharge recording unit 100, recording unit controlling means 110, heating means 120, heat controlling means 140, emission controlling means 150, and sequence controlling means 160. The recording unit 100 has the emission energy generating means 102 including an electrothermal energy converting device which can heat the liquid to form liquid droplets in response to the supply of an electrical signal. This recording unit 100 emits these liquid droplets, thereby recording on the recorded material P. The recording unit controlling means 110 can set the electrical signal and supplies the electrical signal to form the liquid droplets to the emission energy generating means 102 in response to the input of the recording signal SA. The heating means 120 is provided in the recording unit 100 and heats the liquid from the outside. The heat controlling means 140 allows the heating means 120 to heat the liquid and/or sets an electrical signal within a range such as not to form any liquid droplet to the recording unit controlling means 110 and thereby to heat the liquid in accordance with the environmental conditions. The emission controlling means 150 sets the electrical signal to form the liquid droplets to the recording unit controlling means 110, thereby allowing the recording unit 100 to emit the liquid droplets. The sequence controlling means 160 drives the heat controlling means 140 in response to the turn-on of the power supply SW and/or the input of the recording signal SA. After driving the heat controlling means 140, the sequence controlling means 160 stands by for a set time and then drives the emission controlling means 150.

Figure 8:
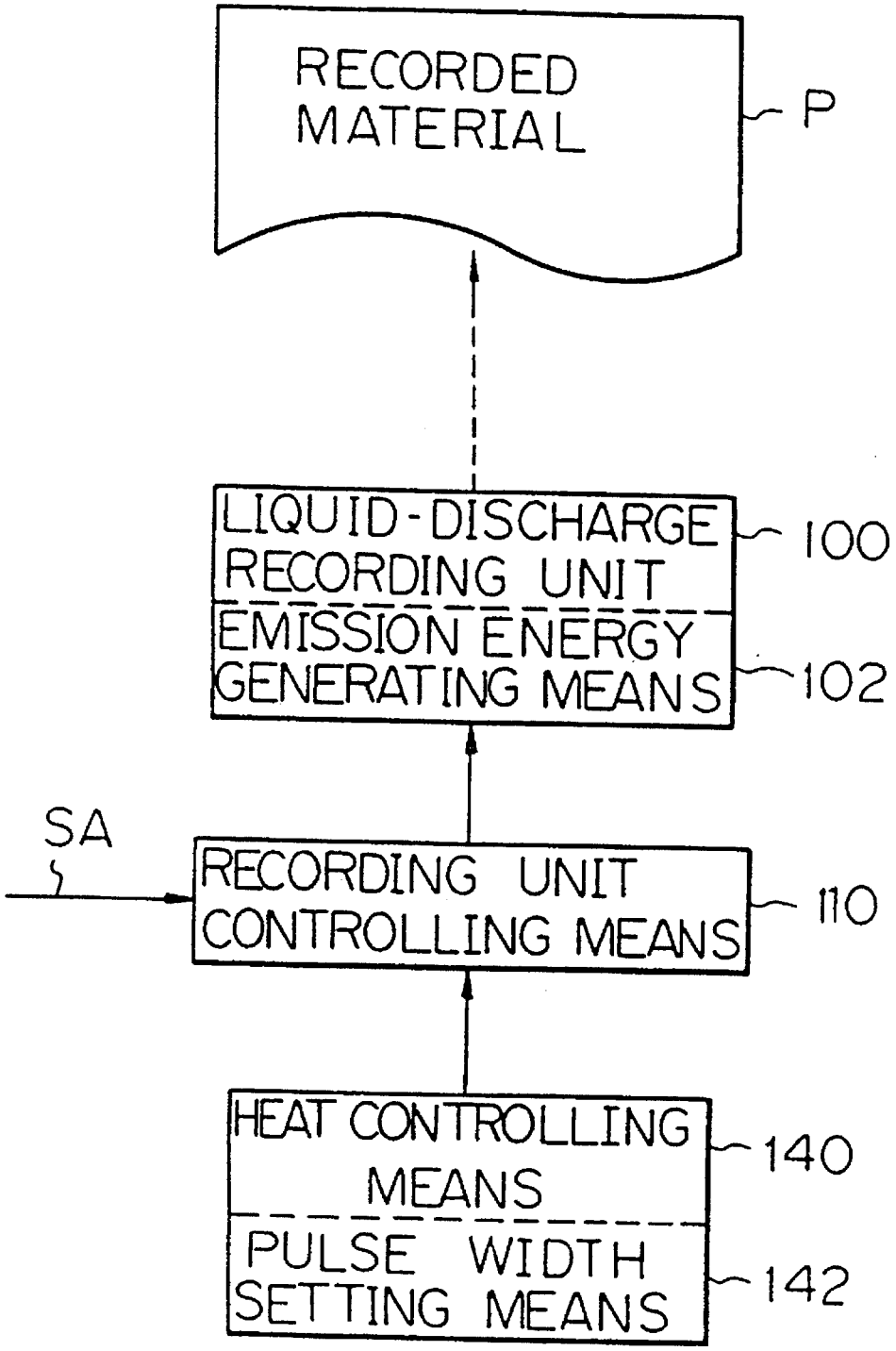
FIG. 8 is a diagram schematically illustrating a liquid jet recording apparatus having pulse width setting means in accordance with the present invention.

The liquid-discharge recording apparatus of the eighth example shown in FIG. 8 comprises the liquid-discharge recording unit 100, recording unit controlling means 110, and heat controlling means 140. The recording unit 100 has the emission energy generating means 102 including an electrothermal energy converting device which can heat the liquid to form liquid droplets in response to the supply of an electrical signal. This recording unit emits these liquid droplets, thereby recording on the recorded material P. The recording unit controlling means 110 can set a pulse width of the electrical signal and supplies the electrical signal to form the liquid droplets to the emission energy generating means 102 in response to the input of the recording signal SA. The heat controlling means 140 has pulse width setting means 142 for setting a pulse width to the recording unit controlling means 110. This heat controlling means sets an electrical signal of a pulse width within a range such as not to form any liquid droplet to the recording unit controlling means 110 and thereby to heat the liquid in accordance with the environmental conditions.

Figure 9:
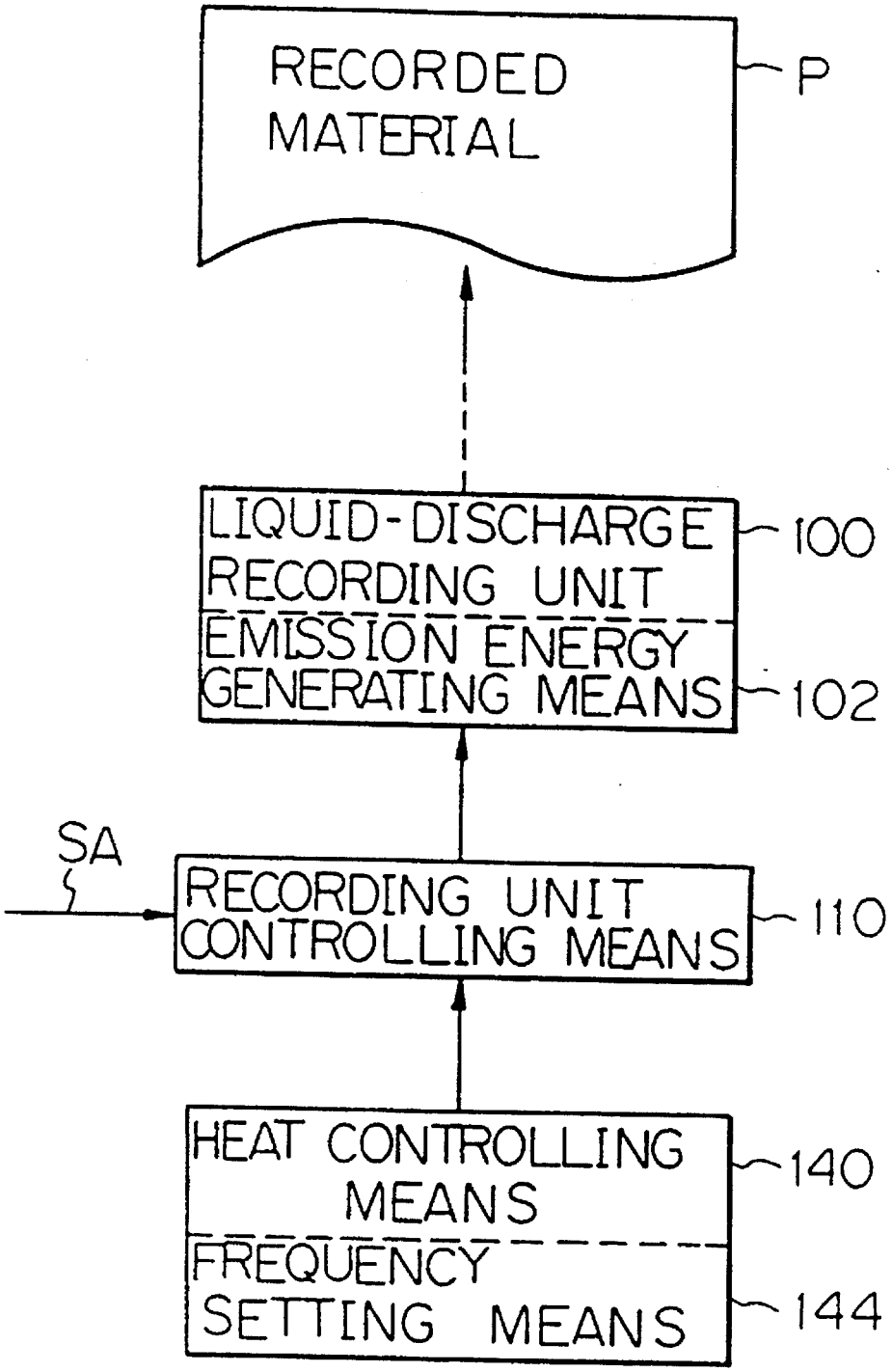
FIG. 9 is a diagram schematically illustrating a liquid jet recording apparatus having frequency setting means in accordance with the present invention.

The liquid-discharge recording apparatus of the ninth example shown in FIG. 9 comprises the liquid-discharge recording unit 100, recording unit controlling means 110, and heat controlling means 140. The recording unit 100 has the emission energy generating means 102 including an electrothermal energy converting device which can heat the liquid to form liquid droplets in response to the supply of an electrical signal. This recording unit emits these liquid droplets, thereby recording on the recorded material P. The recording unit controlling means 110 can set a frequency of the electrical signal and supplies the electrical signal to form the liquid droplets to the emission energy generating means 102 in response to the input of the recording signal SA. The heat controlling means 140 has frequency setting means 144 for setting a frequency to the recording unit controlling means 110. This heat controlling means sets an electrical signal which lies within a range such as not to form any liquid droplet and a frequency of which is higher than the frequency of an electrical signal upon recording to the recording unit controlling means 110 and thereby to heat the liquid in accordance with the environmental conditions.

Figure 10:
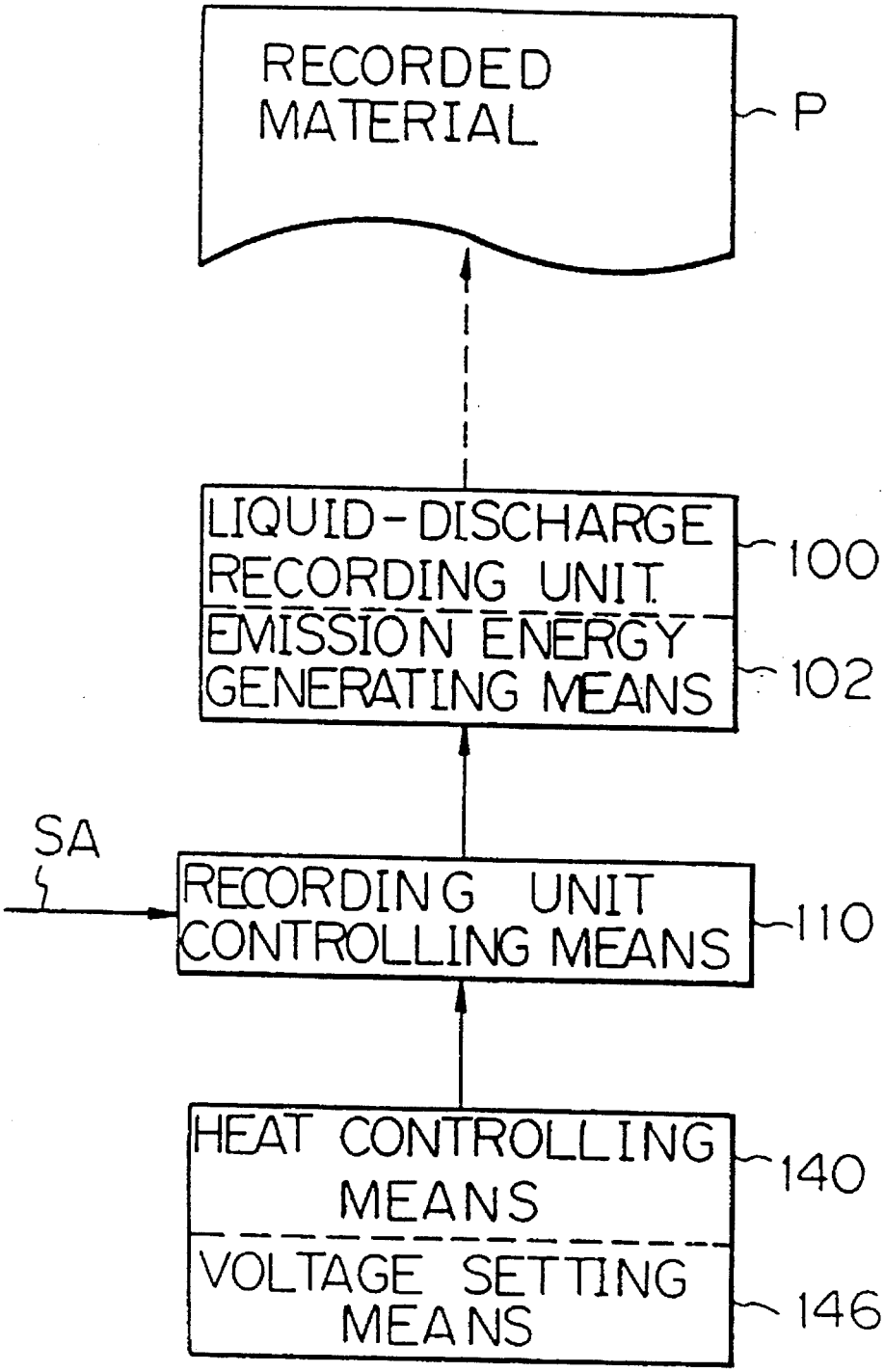
FIG. 10 is a diagram schematically illustrating a liquid jet recording apparatus having voltage setting means in accordance with the present invention.

The liquid-discharge recording apparatus of the tenth example shown in FIG. 10 comprises the liquid-discharge recording unit 100, recording unit controlling means 110, and heat controlling means 140. The recording unit 100 has the emission energy generating means 102 including an electrothermal energy converting device which can heat the liquid to form liquid droplets in response to the supply of an electrical signal. This recording unit emits these liquid droplets, thereby recording on the recorded material P. The recording unit controlling means 110 can set a voltage of the electrical signal and supplies the electrical signal to form the liquid droplets to the emission energy generating means 102 in response to the input of the recording signal SA. The heat controlling means 140 has voltage setting means 146 for setting a voltage to the recording unit controlling means 110. This heat controlling means sets an electrical signal of a voltage within a range such as not to form any flight liquid droplet to the recording unit controlling means 110 and thereby to heat the liquid in accordance with the environmental conditions.

Figure 11:
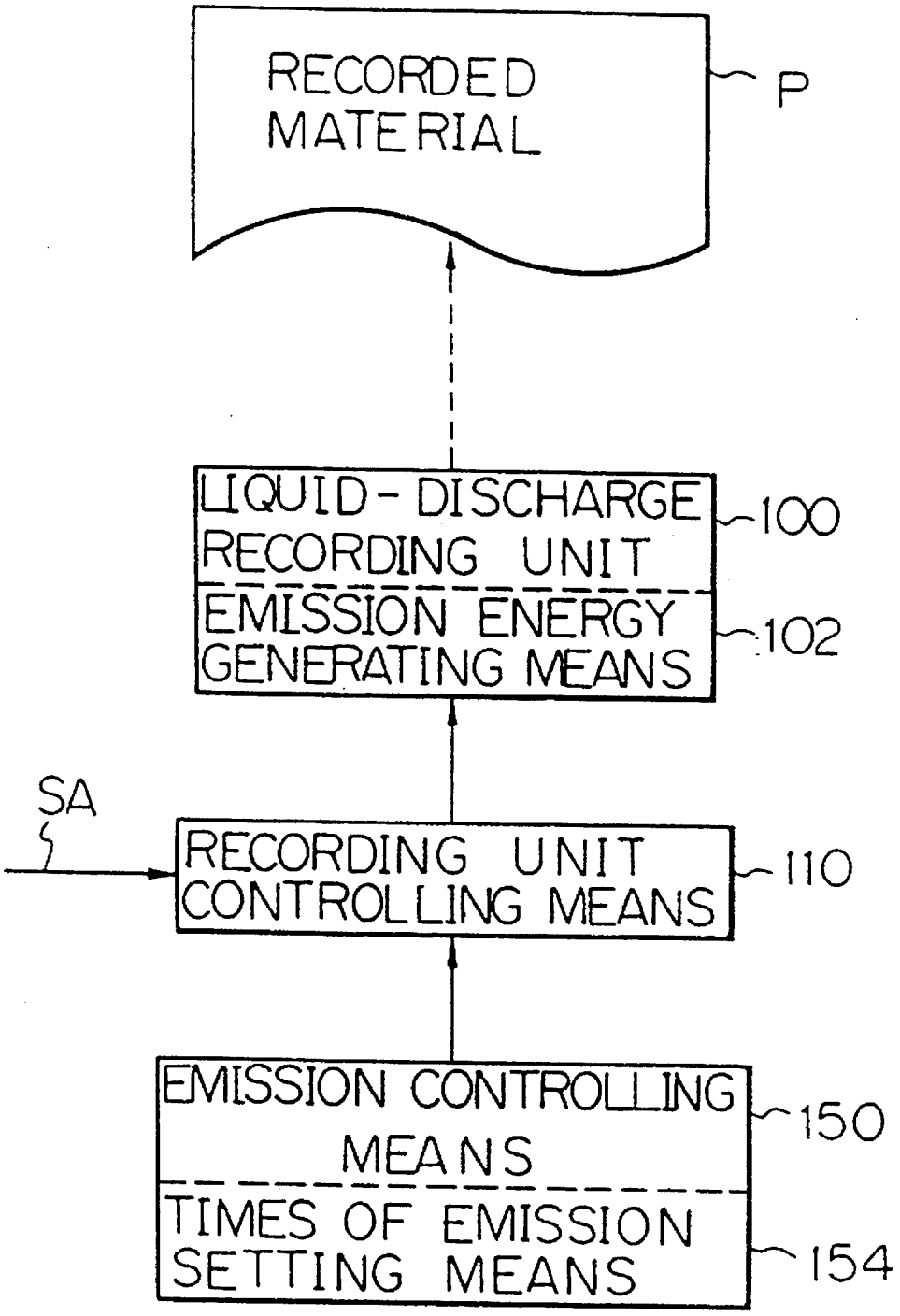
FIG. 11 is a diagram schematically illustrating a liquid jet recording apparatus having times of emission setting means in accordance with the present invention.

The liquid-discharge recording apparatus of the eleventh example shown in FIG. 11 comprises the liquid-discharge recording unit 100, recording unit controlling means 110, and emission controlling means 150. The recording unit 100 has the emission energy generating means 102 which can allow an energy to act on the liquid to form liquid droplets in response to the supply of an electrical signal. This recording unit emits these liquid droplets, thereby recording on the recorded material P. The recording unit controlling means 110 can set the number of emission times and supplies the electrical signal to form the liquid droplets to the emission energy generating means 102 in response to the input of the recording signal SA. The emission controlling means 150 has times of emission setting means 154 for setting the number of emission times in accordance with the environmental conditions. This emission controlling means sets the electrical signal to form the flight liquid droplets to the recording unit controlling means 110, thereby allowing the recording unit 100 to preliminarily emit the liquid droplets by an amount as many as the number of emission times set.

Figure 12:
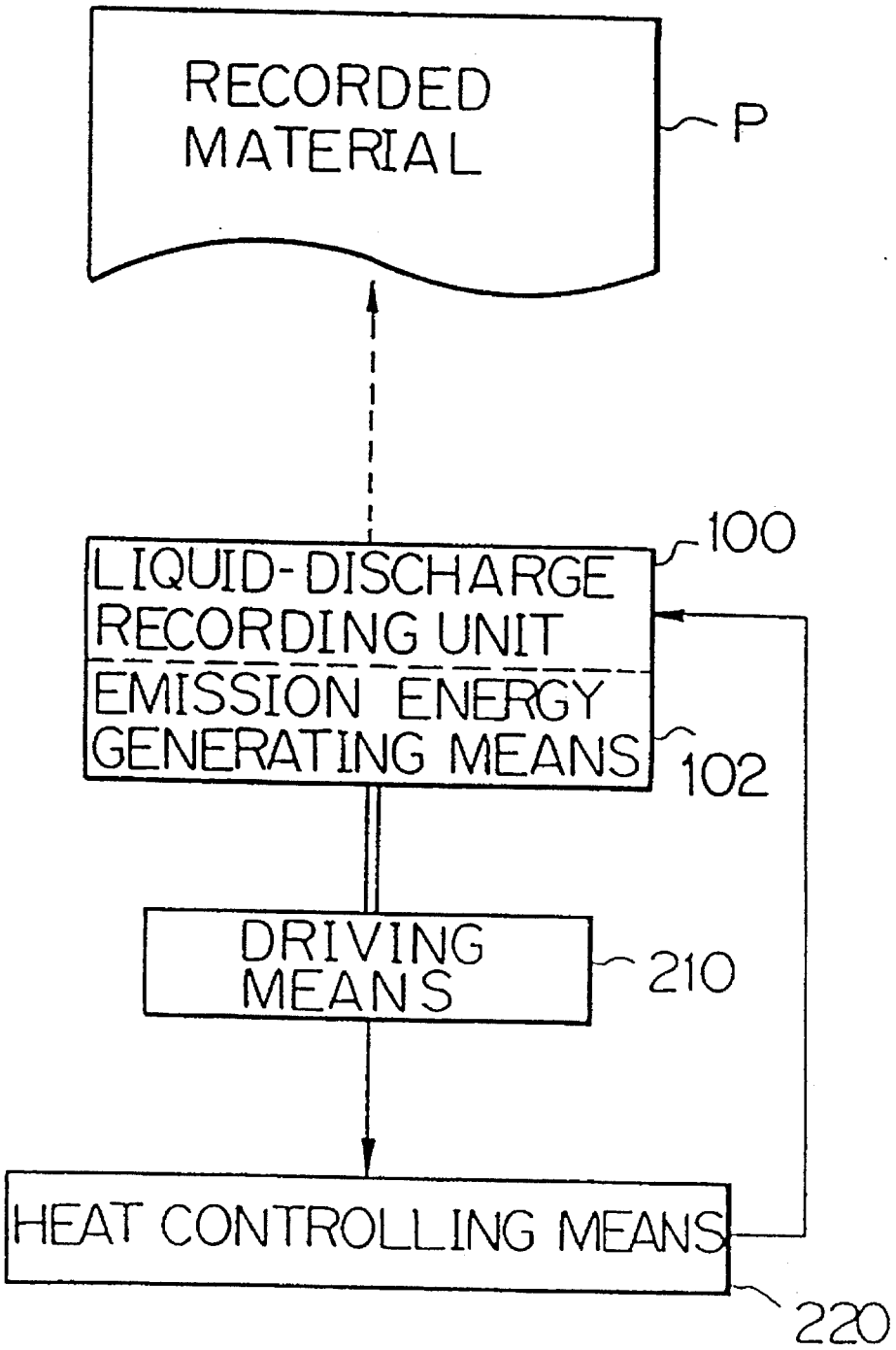
FIG. 12 is a diagram schematically illustrating a liquid jet recording apparatus having heat controlling means responsive to drive means in accordance with the present invention.

The liquid-discharge recording apparatus of the twelfth example shown in FIG. 12 comprises the liquid-discharge recording unit 100, driving means 210, and heat controlling means 220. The recording unit 100 has the emission energy generating means 102 for allowing an energy to act on the liquid to form liquid droplets in response to the supply of an electrical signal. This recording unit emits these liquid droplets, thereby recording on the recorded material P. The driving means 210 moves the recording unit 100 in a predetermined direction with regard to the recorded paper P. The heat controlling means 220 heats the liquid existing in the recording unit 100 when the driving means 210 is stopped.

Figure 13:
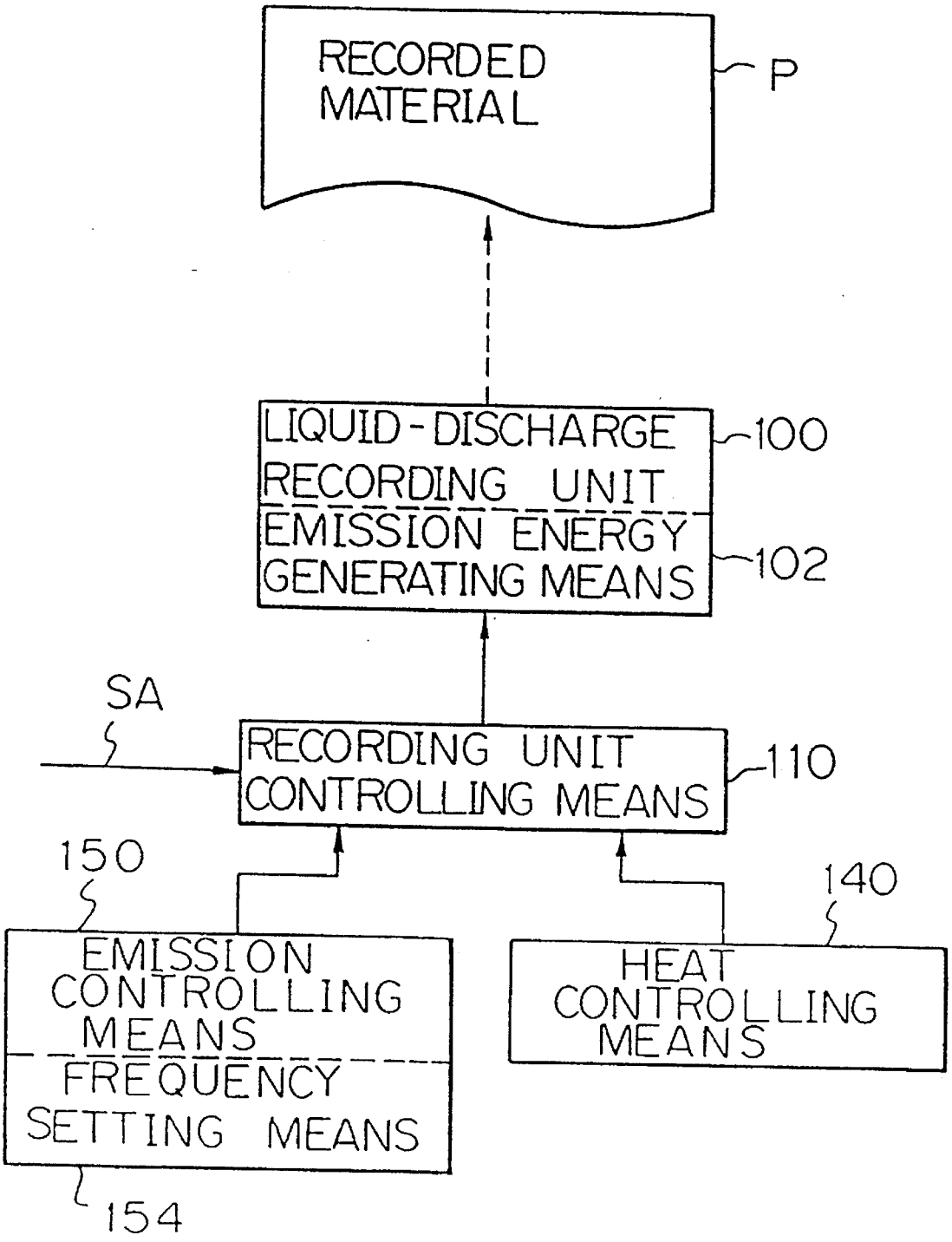
FIG. 13 is a diagram schematically illustrating a liquid jet recording apparatus having emission controlling means, frequency setting means and heat controlling means in accordance with the present invention.

The liquid-discharge recording apparatus of the thirteenth example shown in FIG. 13 comprises the liquid-discharge recording unit 100, recording unit controlling means 110, heat controlling means 140, and emission controlling means 150. The recording unit 100 has the emission energy generating means 102 including an electrothermal energy converting device which can heat the liquid to form liquid droplets in response to the supply of an electrical signal. This recording unit emits these liquid droplets, thereby recording on the recorded material P. The recording unit controlling means 110 can set the electrical signal and supplies the electrical signal to form the liquid droplets to the emission energy generating means 102 in response to the input of the recording signal SA. The heat controlling means 140 sets an electrical signal within a range such as not to form any liquid droplet to the recording unit controlling means 110 and thereby to heat the liquid in accordance with the environmental conditions. The emission controlling means 150 has the frequency setting means 144 for setting a frequency of the electrical signal to the recording unit controlling means 110. This emission controlling means sets the electrical signal to form liquid droplets after the heating and a frequency of which is below a frequency of the electrical signal at the time of the recording thereby allowing the recording unit 100 to emit liquid droplets.

The present invention will then be described in detail hereinbelow with reference to the drawings.

Figure 14:
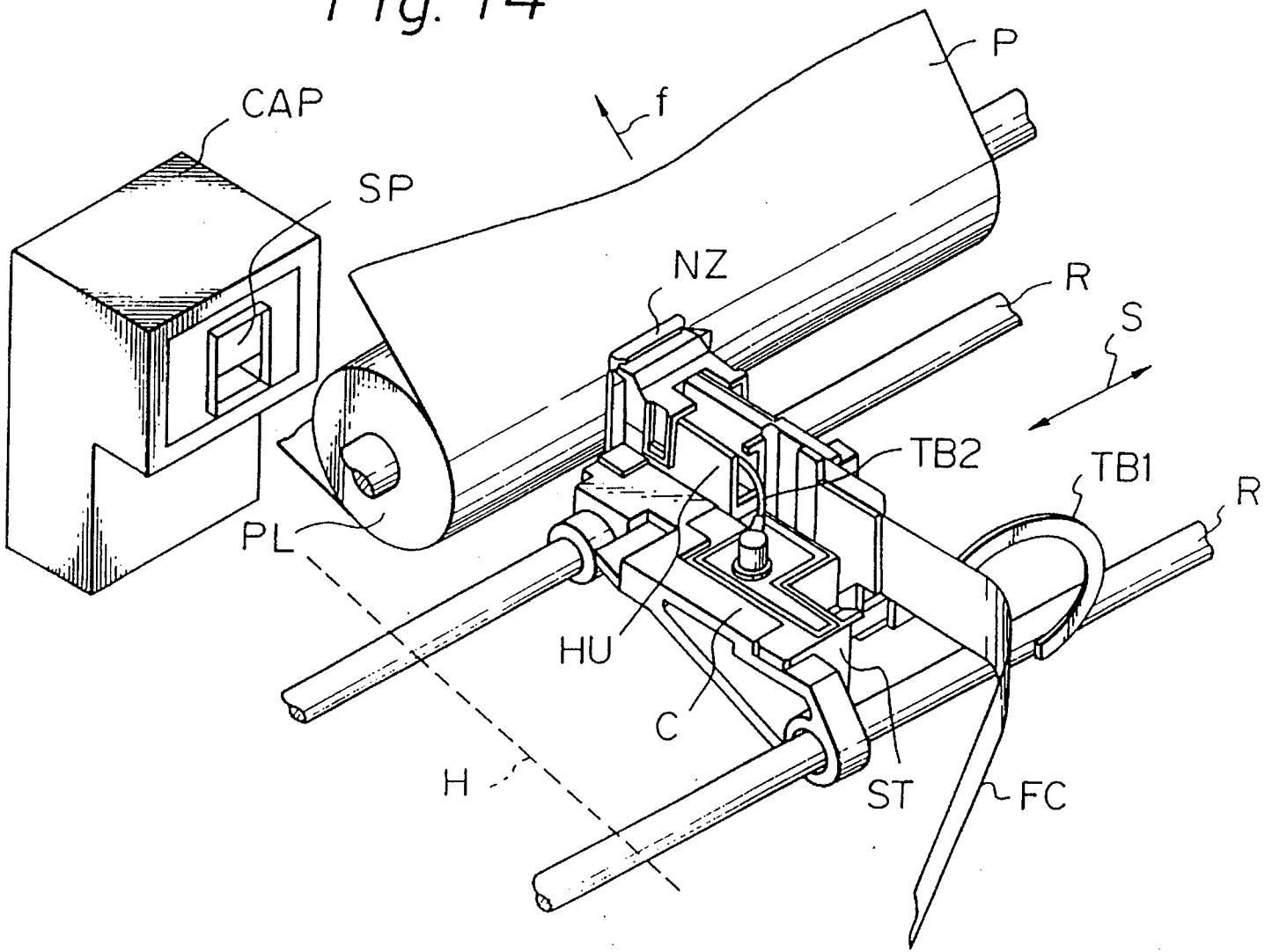
FIG. 14 is a perspective view showing an example of a constitution of an ink-jet printer according to the invention.
Figure 15A:
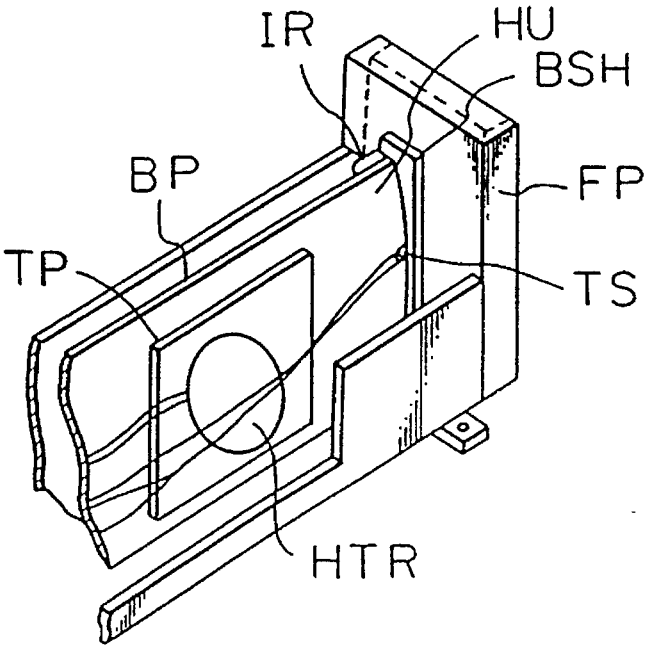
FIGS. 15A and 15B are an enlarged perspective view of a head unit in the printers shown in FIGS. 1 to 13 and an enlarged perspective view of a nozzle unit thereof, respectively.
Figure 15B:
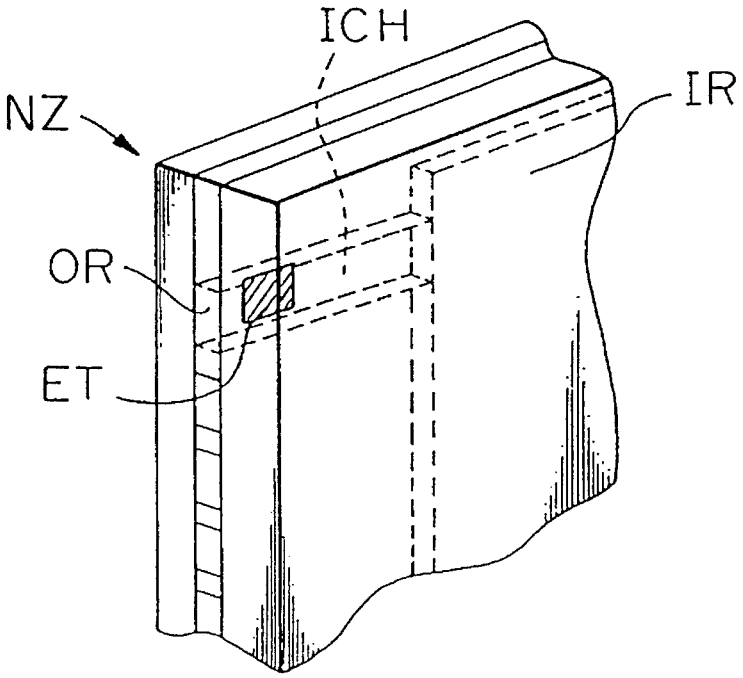

FIG. 14 illustrates an example of a constitution of the recording units of the ink-jet printers to which the invention can be applied, which have been shown in FIGS. 1 to 13 as the examples of arrangements, respectively. This example is applied to the ink-jet printer of the format in which a head unit is mounted to a carriage which moves in a predetermined direction with regard to a recording surface. FIGS. 15A and 15B are an enlarged diagram of the head unit in FIG. 14 and an enlarged diagram of a nozzle unit thereof, respectively.

In FIGS. 14, 15A, and 15B, HU denotes a liquid-discharge recording unit mounted on a carriage C. It is also possible to provide as many liquid-discharge recording units HU as the number of colors of inks which are used. FC indicates a flexible cable consisting of a set of signal lines to control the emission of the ink by the recording unit HU and the like.

The carriage C is fixed to, for example, a belt or the like and moves in the directions indicated by arrows S in FIG. 14 by driving means such as a motor or the like. The guide rails R guide the carriage C so that it moves in the directions S.

P denotes the recorded material such as a paper or the like which is conveyed in the direction indicated by an arrow f in FIG. 14. PL represents a platen to form the recording surface of the recording paper P. Namely, the carriage C moves in the directions S in the diagram by the driving means along the guide rails R, thereby making it possible to record on the recording surface of the recording paper P.

ST denotes a sub-tank provided in the carriage C; $TB_1$ is an ink supply tube for communicating a main tank (not shown) with the sub-tank ST; and $TB_2$ is an ink supply tube unit for communicating the sub-tank ST with a liquid chamber IR in the head unit HU.

In addition, CAP is a cap member arranged to face the recording unit HU at a home position H of the carriage C in the directions S. When the carriage C is located at the home position, the cap member CAP can move toward the recording unit HU by driving means such as a motor or the like and can abut on the emitting surface thereof. A collecting member SP abuts on the emitting surface of the recording unit HU and collects the ink and is formed of, for example, a water absorption porous material.

In FIG. 15A, BP is a base plate on and over which the supply tube unit $TB_2$, the liquid chamber IR, a nozzle unit NZ, the flexible cable FC, etc. are arranged and by which these components are supported. BSH denotes an elastic member for supporting the peripheral portion of the nozzle unit; FP is a front plate; TS is a temperature sensor such as a thermistor or the like to detect a temperature; and HTR is a heater consisting of, for instance, an electrothermal energy converter such as a positive characteristic thermistor or the like attached to the heat unit HU in order to heat the ink and keep it warm from the outside. TP is a heat conducting plate.

On one hand, in FIG. 15B, OR denotes an orifice serving as an ink emitting hole. In this embodiment, a predetermined number of orifices OR are vertically arranged in the nozzle unit NZ. ICH is a liquid channel for communicating the orifices OR with the liquid chamber IR. ET is an emitting heater serving as an emission energy generating device for applying thermal energy for emission to the ink existing in the liquid channel ICH.

To record using the above-mentioned recording apparatus, the ink is first supplied to the sub-tank ST from the main tank through the supply tube $TB_1$. Further, the liquid chamber IR and liquid channel ICH are filled with the recording liquid through the supply tube unit $TB_2$. Next, an electrical signal is applied to the emitting heater ET through the flexible cable FC from liquid droplet emitting signal generating means which will be explained hereinafter, thereby energizing the heater ET. Thus, the heater ET generates a heat energy and this heat energy is applied to the recording liquid existing in the liquid channel ICH near the heater ET, causing an air bubble to be produced in the recording liquid which is accompanied with an instantaneous increase in volume of the recording liquid in that portion. The recording liquid existing in the downstream portion of the emitting heater ET is emitted from the orifice OR, so that the liquid droplet of the recording liquid is formed. This recording liquid droplet is deposited on the recorded material P such as a paper or the like fed in front of the nozzle unit, so that the recording is performed.

Figures 16, 16A, 16B:
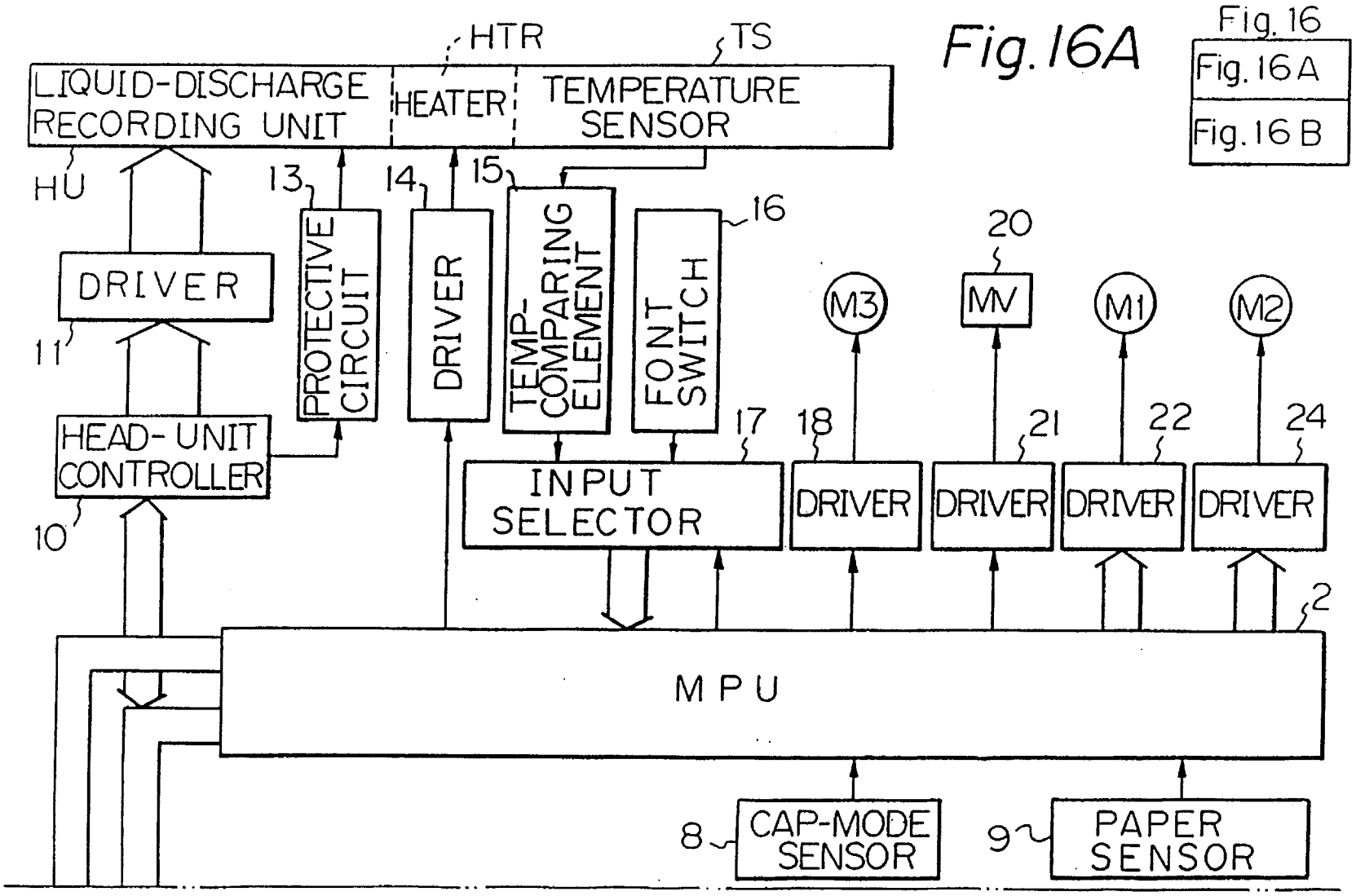
FIGS. 16, 16A and 16B are a block diagram showing an example of an internal circuit arrangement of the ink-jet printer according to the invention.
Figure 16B:
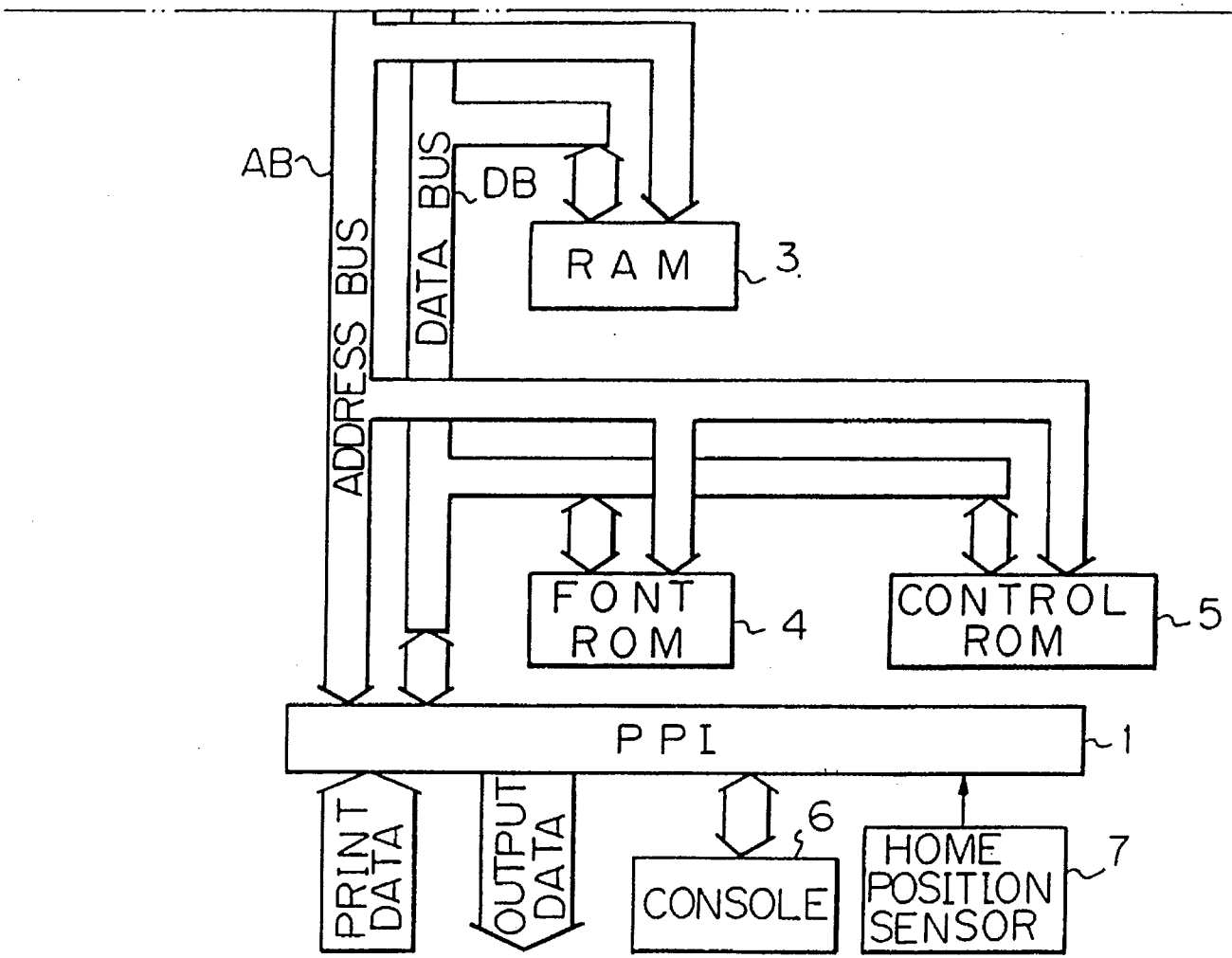

FIG. 16 shows an example of an arrangement of a control apparatus of the ink-jet printer of the invention. For example, it is assumed that this control apparatus receives print data from a host computer and stores the print data of one line and controls a printing head by a controller of the head unit HU, thereby printing.

In FIG. 16, a programmable peripheral interface (hereinafter, referred to as a PPI) 1 first receives in parallel the print data which is sent from the host computer of the printer according to the embodiment and transmits the print data to a microprocessing unit (hereinafter, referred to as an MPU) 2. The PPI 1 also controls a console 6 and performs an inputting process of a home position sensor 7. The MPU 2 controls each section in the printer and executes a processing procedure which will be explained hereinlater. A RAM 3 serves as a line buffer memory for storing the print data received by the PPI 1 by an amount of one line. Reference numeral 4 denotes a ROM to generate fonts of print output characters, and 5 is a control ROM in which processing procedures (FIGS. 5 to 7) which are executed by the MPU 2 are stored. Those components 1 to 5 are connected through an address bus AB and a data bus DB.

The console 6 has a keyboard switch, an indicating lamp, and the like. The home position sensor 7 is disposed near the home position of the carriage C. A cap-mode sensor 8 senses the state of the cap member CAP, namely, detects whether the cap member CAP is coupled with the head unit HU or not. A paper sensor 9 detects the absence of the printing paper.

A head-unit controller 10 latches the print data and print output time and starts the print output in response to a command from the MPU 2. Namely, in this embodiment, the controller 10 is used as a dedicated integrated circuit (IC), thereby realizing a high processing speed. For example, the controller disclosed in Japanese Patent Application No. 162802/1984 by the same applicant as this application may be used as the controller 10. The print data which has once latched is outputted as it is, unless otherwise a change is requested.

Reference numeral 11 denotes a driver to drive the head unit HU in response to the controller 10; 13 is a protective circuit of the head unit HU; 14 a driver to drive the heater HTR for heating the ink and keeping it warm which is provided for the head unit HU; 15 a temperature comparing element of the ink temperature sensor TS provided for the head unit HU; 16 a font switch to instruct the switching of the print font; and 17 an input selector to switch signals of the device 15 and switch 16 and is controlled by the MPU 2.

Numeral 18 denotes a driver to drive a motor $M_3$ for moving the cap member CAP with respect to the head unit HU; 22 and 24 are drivers to drive a motor $M_1$ for feeding the paper and a motor $M_2$ for moving the carriage, respectively; and 20 and 21 are a solenoid for a valve and a driver thereof which are used to remove the air in the head unit HU, respectively.

The outline of the processes in the case of the ink-jet printer shown in FIGS. 14 to 16 according to this embodiment will now be described. In this embodiment, when the power supply of the printer is turned on and when the printing is started, the head unit HU is subjected to a preheating process and a preliminary emitting process, thereby obtaining a good ink emitting state. In addition, the capping to the head unit HU is properly controlled in conjunction with those processes. It is assumed that the preheating process includes the execution of an external heating process and/or an internal heating process.

In this case, the external heating denotes that the ink is heated from the outside of the head unit HU by driving the heater HTR and the internal heating denotes that the ink is heated in the head unit HU by supplying a print output pulse within a range such as not to emit any ink from the head unit HU to the emission energy generating device. A print output start signal is sent to the head-unit controller 10 at every set frequency during the internal heating.

When the preheating, particularly, the internal heating is performed, it is desirable to apply a print output of proper pulse width, frequency, and voltage to the head unit HU. However, the use of the head-unit controller 10 enables the sufficient processes to be carried out even at an ordinary processing speed of the MPU. Namely, according to this embodiment, parameters of respective print outputs can be freely changed and set in accordance with the necessity, so that the head unit can be heated in the optimum manner and the software can be simplified and a high processing speed can be realized.

On one hand, even in the case of performing the preliminary emission as well, it is preferable to apply a suitable print output having a pulse width, a frequency, and a voltage as parameters to the head unit HU similarly to the above. In this embodiment, those parameters and the number of emission times are changed in accordance with the environmental conditions. The embodiment can easily cope with such a case by the software and the optimum preliminary emission can be performed. In addition, in this embodiment, all dots of the print outputs at the time of the preliminary emission are set to "1" using the head-unit controller 10. Therefore, there is no need to change the print data every time with respect to the print data in this case, so that the software can be simplified and a high processing speed can be realized.

Printing state optimizing processes in this embodiment will then be described hereinbelow.

Figures 1, 17A:
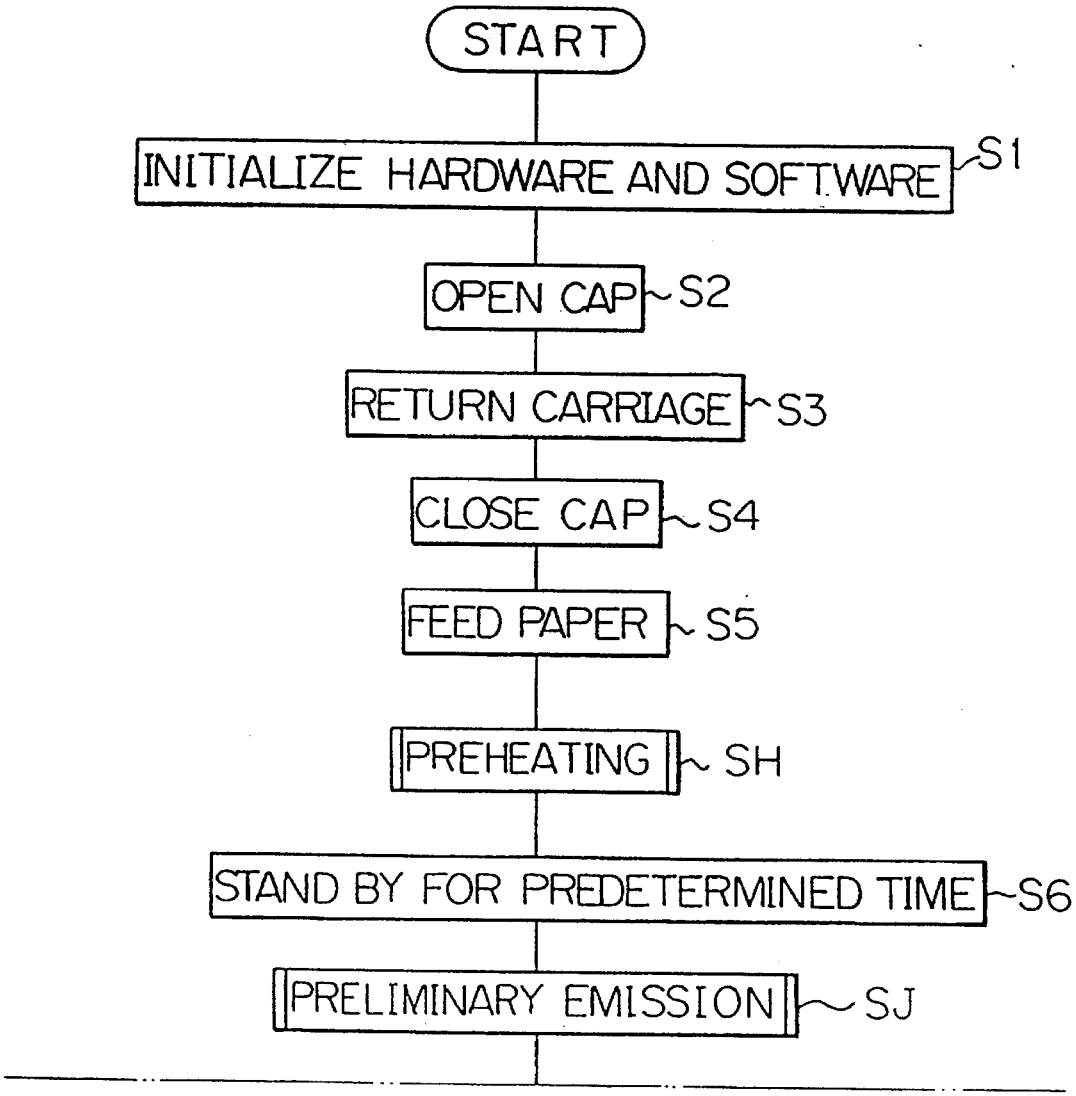
Figures 2, 17A:
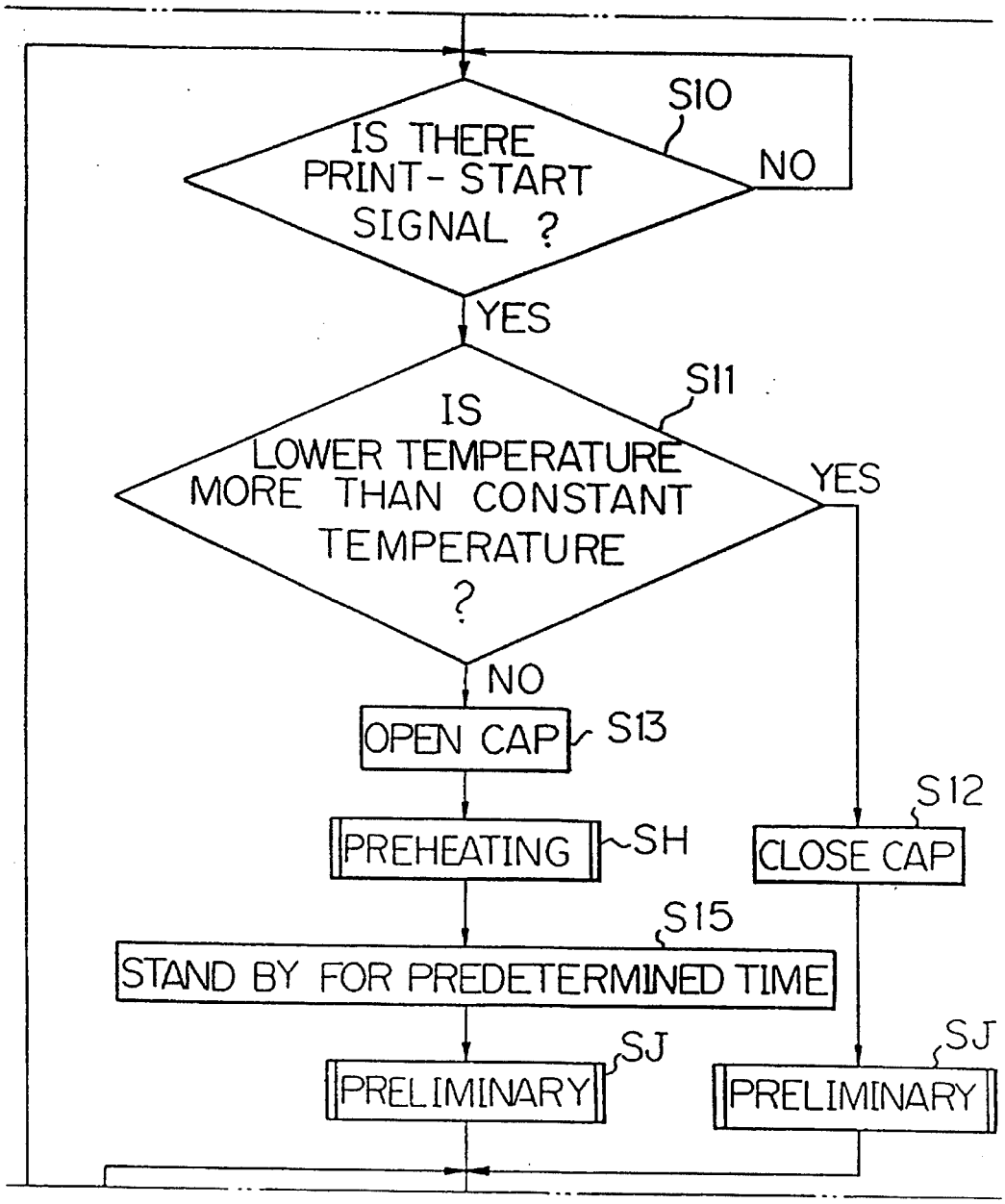
Figures 3, 17A:
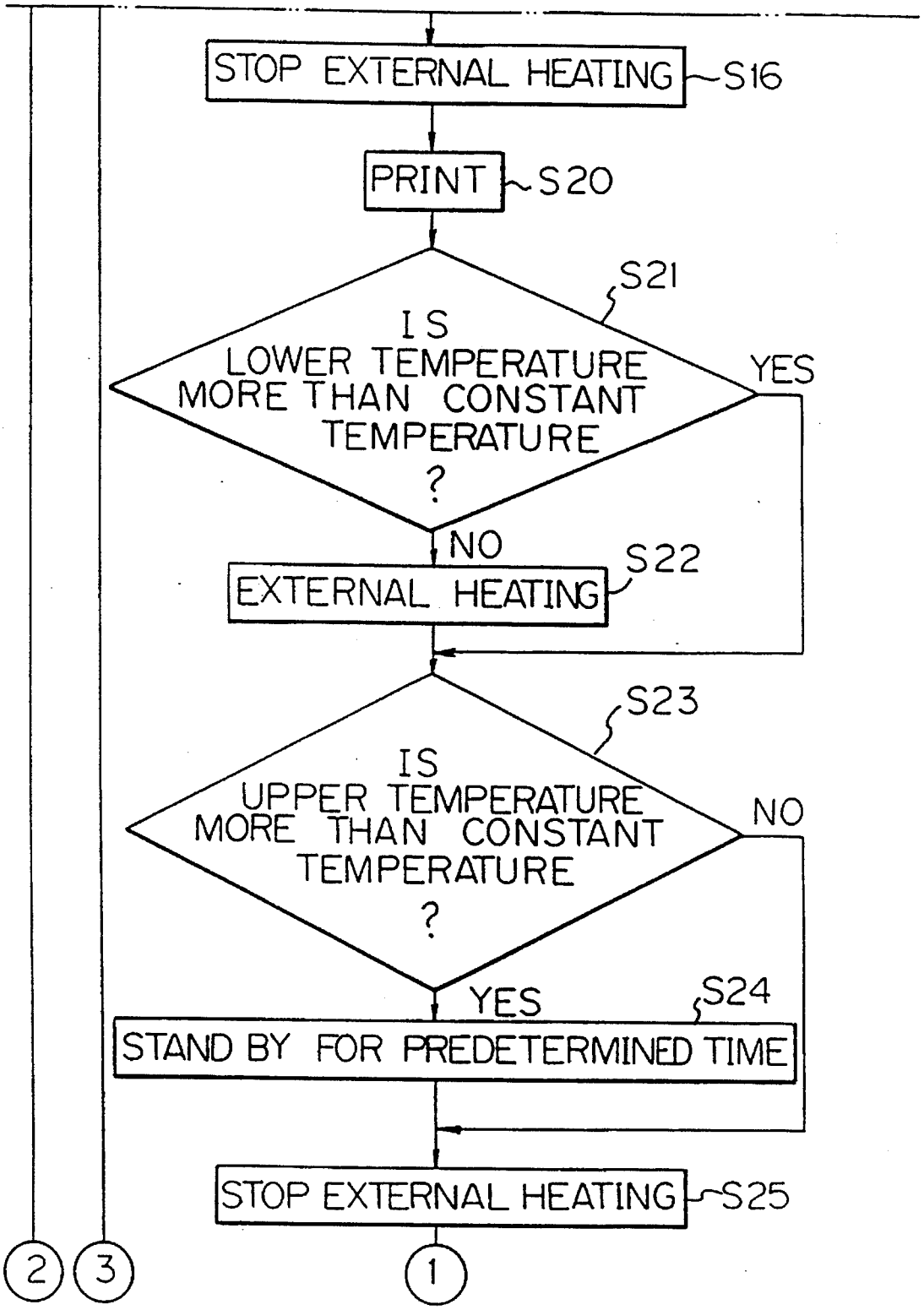
Figure 17B:
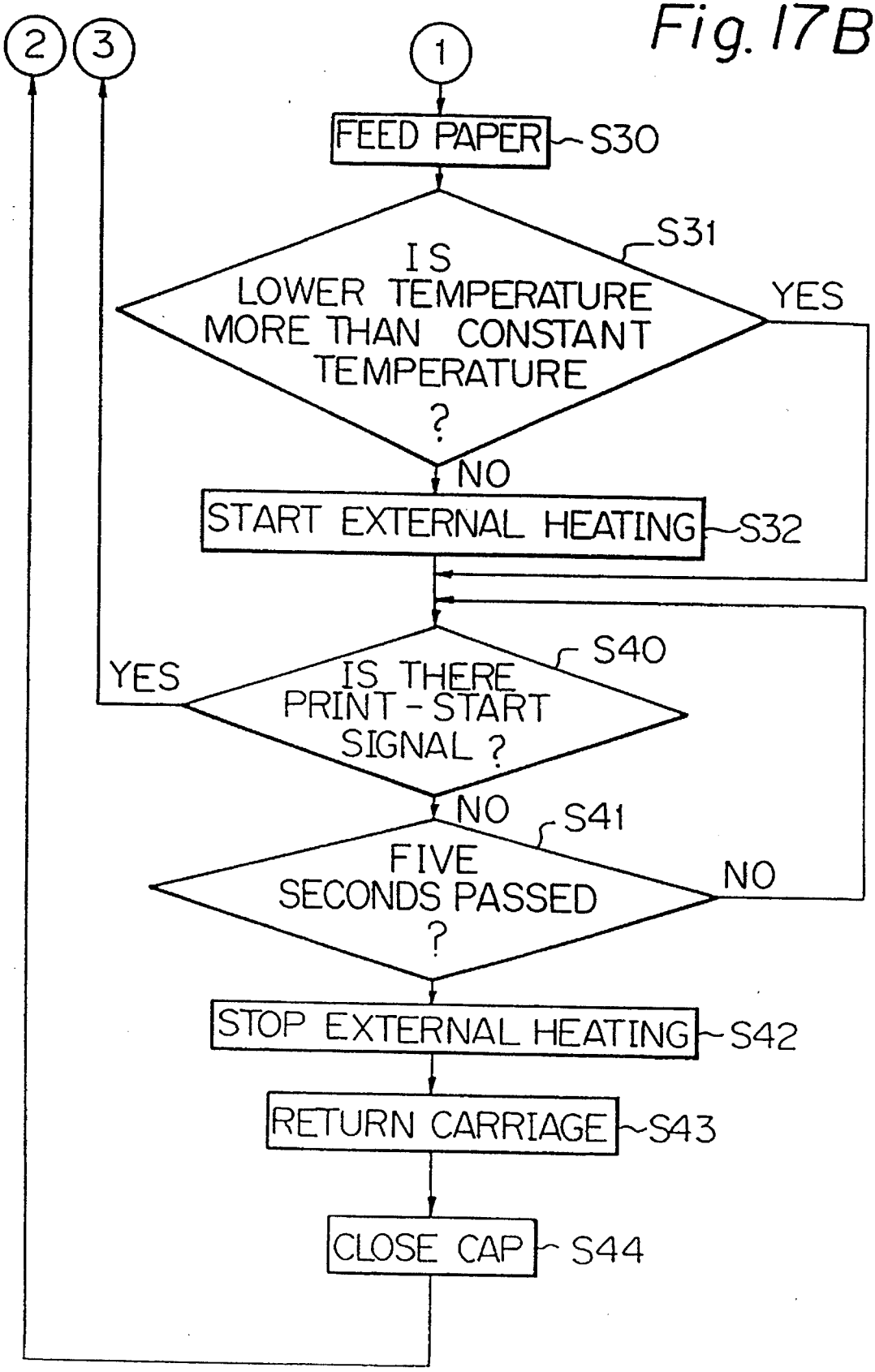

FIGS. 17A and 17B show an example of the printing state optimizing process procedure according to the present invention.

Immediately after the turn-on of the power supply of the printer, as an initializing process, the PPI 1 and head-unit controller 10 of the hardware are initialized, and, for the software, the line buffer memory RAM 3 is initialized and the operation of the control ROM 5 is checked, and the respective parameters which are used for processing are initialized (step S1).

After completion of the initializing process, the head cap motor $M_3$ is driven to open the head cap while monitoring the cap-mode sensor 8 by the MPU 2 (step S2). Monitoring the home position sensor 7, the carriage motor $M_2$ is driven to return the carriage C to the home position H (step S3). Then, monitoring the sensor 8, the cap motor $M_3$ is driven to close the head cap to the head unit HU (step S4). Further, the motor $M_1$ is driven to feed the recording paper by an amount of, e.g., one line (step S5). After those processes, the head unit HU is initialized.

In the initializing process, the preheating process (step SH) of the head unit HU is first started.

Figure 18:
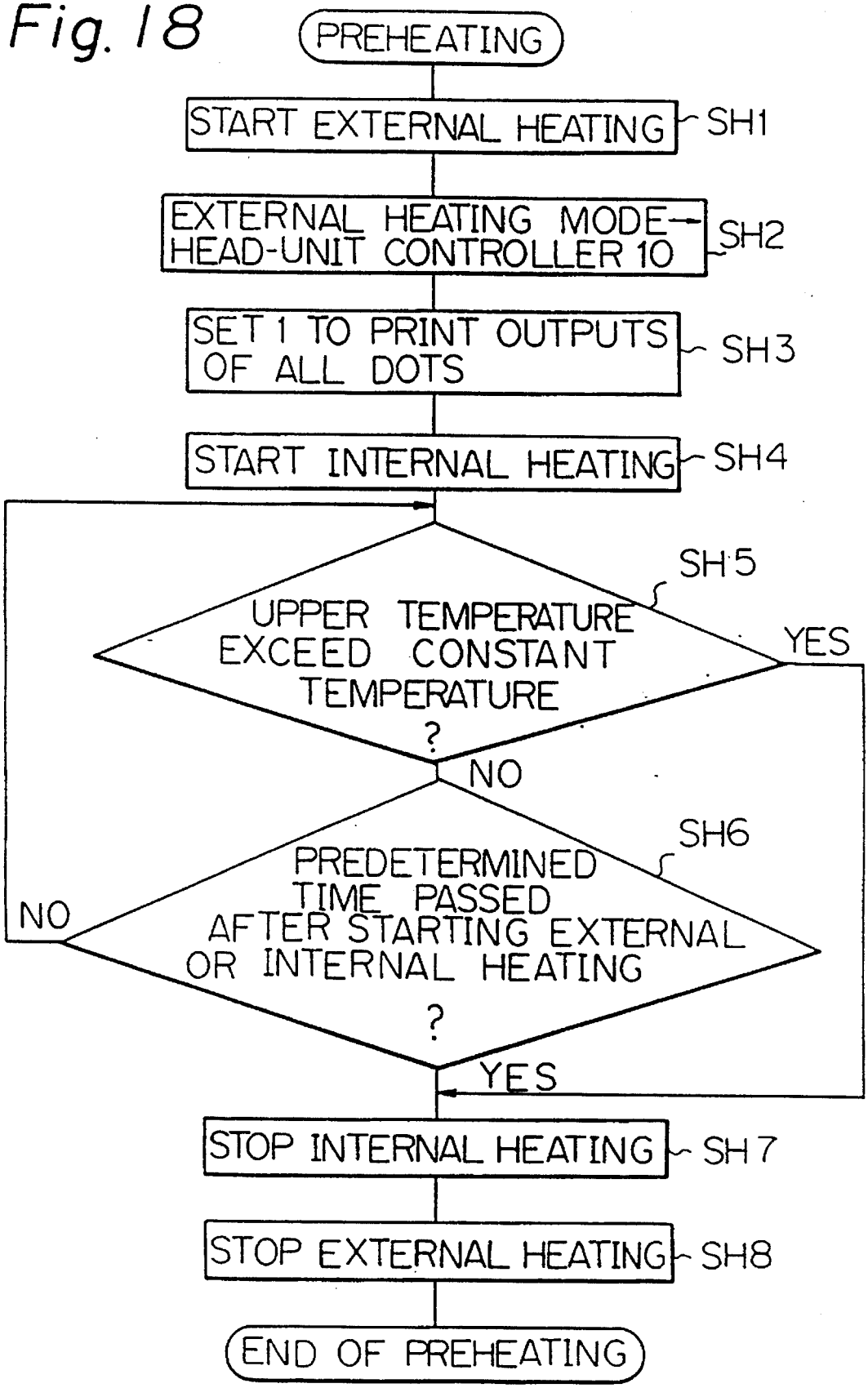
FIGS. 18 and 19 are flowcharts showing an example of a preliminary heating process procedure and an example of a preliminary emitting process procedure in the processes shown in FIGS. 17A and 17B, respectively.

FIG. 18 shows an example of the preheating processing procedure for performing the external heating and internal heating. As mentioned above, for the internal heating, an output of a pulse width, a voltage, and a high frequency within ranges such as not to emit any ink is applied to the head unit HU from the controller 10, thereby allowing the heat to be generated in the head unit HU. For the external heating, the heater HTR provided for the head unit HU is used as a heating member and the driver 14 is turned on by the MPU 2, thereby heating the head unit HU. The external heating is started in step SH1 and the head-unit controller 10 is set into the external heating mode in step SH2. In the next step SH3, the print outputs of all dots are set to "1". The internal heating is started in step SH4. In the case of performing the internal heating, the pulse width, voltage, and frequency of the print output are properly set as will be explained herein later.

After the preheating of the head has been started in this manner, a temperature of the head unit HU is checked to see if the upper temperature of the head unit HU exceeds a constant temperature or not (step SH5). If YES, the preheating is finished. If NO, step SH6 follows and the preheating is started and a check is made to see if a predetermined time has passed after the start of the external or internal heating (step SH6) . If YES in step SH6, namely, when the upper temperature does not exceed the constant temperature even after an expiration of the predetermined time, step SH7 follows. In step SH7, a command to stop the internal heating is sent to the controller 10 to prevent the head from being thermally broken, thereby stopping the internal heating. In the next step SH8, the driver 14 is turned off to stop the external heating. Namely, in this case, the preheating is stopped and the processing routine is returned to step S6 in FIG. 17A. The constant temperature on the upper side denotes the upper limit operating temperature of the head unit HU (for example, 42° C). It will be obvious that the sequence of the start and stop of the external heating and internal heating may be changed.

Referring again to FIG. 17A, after the preheating was stopped, the apparatus stands by for a predetermined time and the temperature distribution in the head unit HU locally heated is averaged (step S6). After an elapse of the predetermined standby time, the preliminary emitting process is performed (step SJ). In the case where the sudden heating process was executed for the preheating at the time of turn-on of the power supply, the standby time may be set to a relatively long time. In this case, it may be set to, e.g., 500 msec.

Figure 19:
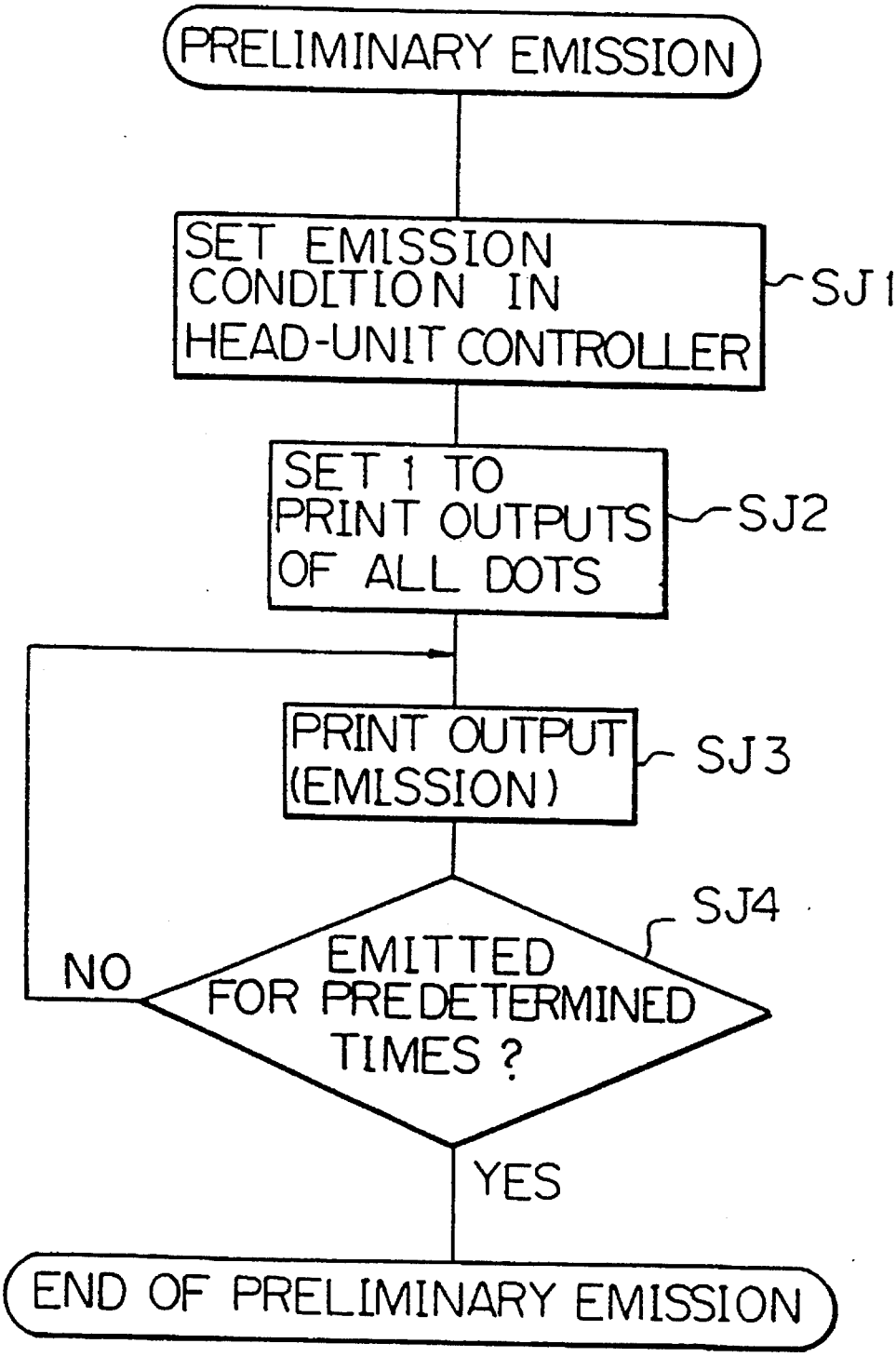

FIG. 19 shows an example of the preliminary emitting process procedure. The emission condition is first set to the head-unit controller 10 in step SJ1. Then, the print outputs of all dots are set to "1" in step SJ2. In step SJ3, the print output is applied to the head unit HU to emit the ink. This operation is repeated for a predetermined number of emission times due to the process in step SJ4. Thereafter, the processing routine is returned to step S10 in FIG. 17A and the apparatus enters the print standby state. Namely, the initializing process for the head unit HU is finished in this manner. Then, the procedure is shifted to the print standby state from the host computer. On one hand, the specified number of emission times and the parameters of the emission condition can be properly set in accordance with the environmental conditions as will be explained hereinafter.

When a printing signal is supplied from the host computer in the standby state of a printing signal (step S10), the print data is latched into the PPI 1 and transferred to the line buffer RAM 3. A signal from the temperature sensor TS provided for the head unit HU is detected by the temperature comparing device 15 and a check is made to see if the lower temperature is more than a constant temperature, e.g., higher than 20° C. or not (step S11). If YES, the head-cap motor $M_3$ is driven to open the cap (step S12). Then, the controller 10 is set to the ordinary printing mode to perform the preliminary emission (steps SJ; refer to FIG. 19). On the contrary, if NO in step S11, namely, when it is determined that the lower temperature is lower than the constant temperature, the cap is closed (step S13) and then the preheating process (steps SH; refer to FIG. 18) is performed. After the standby state for the predetermined time (step S15), the emission condition and the number of emission times are further set to the controller 10 and the preliminary emission is performed (steps SJ; refer to FIG. 19).

In this case, the standby time can be set to be shorter than the above-mentioned standby time when the sudden heating such as at the time of actuation of the recording unit is not performed. The constant temperature on the lower temperature side means the lower limit operating temperature of the head unit HU.

Next, the driver 14 is turned off to stop the external heating (step S16) and the apparatus enters the printing state. Namely, the heating process is not executed during the printing operation when the carriage motor $M_2$ is driven.

In addition, the heating process can be also performed without increasing an electric power consumption in conjunction with the printing process in step S20. Namely, during the moving operation of the carriage, when the moving direction is changed at both ends of the movement range of the carriage, the carriage C once stops at these turning points; therefore, the heating process may be executed at this time.

After the start of the printing, when the printing of, for example, one line is carried out and the carriage motor $M_2$ stops (step S20), a check is then made to see if the lower temperature of the head unit HU is more than the constant temperature or not (step S21). If YES, step S23 follows. If NO, the driver 14 is driven to perform the external heating (step S22) and then step S23 follows. That is, a check is made to see if the upper temperature of the head unit HU is more than the constant temperature or not (step S23). If YES, the external heating is immediately stopped (step S25). If NO, the apparatus stands by for a predetermined time (e.g., 200 msec) (step S24) and thereafter the external heating is stopped (step S25 ).

Next, as shown in FIG. 17B, the paper feed motor $M_1$ is driven to feed the paper (step S30) and processes in steps S31 and S32 similar to those in steps S21 and S22 are executed and then step S40 follows. Namely, the internal timer is turned on by the MPU 2 and a check is made to see if the print data has been latched in the PPI 1 within a predetermined time ( for example, within five seconds) or not (steps S40 and S41). If YES, step S16 in FIG. 17A follows. If NO, the driver 14 is turned off to stop the external heating (step S42). The carriage motor $M_2$ is driven to return the carriage C to the home position H (step S43). Then, the cap motor $M_3$ is driven to close the cap (step S44). and the processing routine is returned to step S10 in FIG. 17A.

In this manner, according to this embodiment, after the preheating process has been executed, the preliminary emitting process to emit the liquid droplets which are not used for the recording is carried out. Thus, the recording interruption or stop interval becomes very long and even in the case where the viscosity of the recording liquid remarkably increases due to the evaporation of the solvent component as well, the emitting operation upon printing can be optimized. That is, the portion of a high viscosity of the recording liquid is first heated due to the preheating process and its temperature increases, so that the viscosity of the recording liquid is reduced to a value such that the liquid droplets can be emitted. By subsequently performing the preliminary emitting process in this state, the recording liquid in this portion is drained to the outside of the liquid channel ICH, so that the recording liquid a viscosity of which lies within a range suitable to emit is supplied to the portion near the emitting heater ET and thereafter the good emitting state of the recording liquid is derived. To confirm stability of this emitting state, the applicant of this application has performed the following experiments.

[Experiment using the embodiment]

The ink-jet printer according to this embodiment having the recording head unit as shown in FIG. 15B was used, in which twenty-four orifices (a diameter of each orifice is 50×40 μm) are vertically arranged in a line at regular intervals of 0.141 mm in the recording head unit. This recording apparatus was filled with the recording liquid containing the following compositions. At the restart of the recording after an expiration of the recording interruption period of twelve hours under circumstances at 25° C. and 30%RH, the signal of a voltage 23.5 V, a pulse width 5 μsec, and a frequency 10 kHz was applied to the emitting heater ET when the preheating was performed. Next, the signal of a voltage 23.5 V, a pulse width 10 μsec, and a frequency 2 kHz was applied to the emitting heater ET by an amount of a hundred pulses, thereby emitting the liquid droplets which are not used for recording. The recording apparatus regarding the defective emission after the recording interruption was evaluated by measuring the number of liquid droplets which were not emitted in response to the recording signal until the liquid droplets of the recording liquid for use in the recording have been emitted from all of twenty-four orifices. The result is shown in Table 1.

The compositions of the recording liquid used for recording are as follows.

C.I. direct black 19 ..... 2 weight part

Diethylene glycol ..... 30 weight part

Water ..... 70 weight part

[Experiment using the comparison example]

The recording apparatus having a constitution similar to the embodiment and in which only an electrical signal to emit recording liquid droplets for use in recording is applied to the emitting heater upon recording was used. This recording apparatus was filled with the above-mentioned recording liquid. At the restart of the recording after an expiration of the recording interruption period of twelve hours under circumstances at 25° C. and 30%RH, only the electrical signal of a voltage 23.5 V, a pulse width 10 μsec, and a frequency 2 kHz to emit liquid droplets was applied to the emitting heater and the recording was performed. The recording apparatus after the recording interruption with regard to the defective emission was evaluated in a manner similar to the experiment using the embodiment. The result is shown in Table 1.

TABLE 1

| | The number of liquid droplets which are not emitted until the liquid droplets are emitted from all of 24 orifices | Recording interruption period time |
|---|---|---|
| Embodiment | 0 | 12 |
| Comparison example | The liquid droplets were not emitted from two of 24 orifices. | 12 |

It will be understood from Table 1 that even at the restart of the recording after the elapse of such a particularly long recording interruption or stop period, good and stable emitting state of liquid droplets can always be obtained.

Next, an explanation will be made with respect to the setting of the parameters of the pulse width, frequency, voltage, etc. of the print output in the preheating process and preliminary emitting process.

The degree of deviation of the viscosity of the recording liquid existing in the liquid channel ICH, particularly, near the orifices OR from the proper range due to the recording interruption or stop period individually differs in dependence on the characteristic of the apparatus which is used, the physical property of the recording liquid, the environmental conditions such as temperature, humidity, and the like of the location where the apparatus is installed and used, and the like. Thus, the parameters of the print output in the preheating process, particularly, in the internal heating process are suitably selected in accordance with the individual apparatuses and their use conditions.

On one hand, the signal which is supplied to the emitting heater ET in the preliminary emitting process is applied under the conditions such that the recording liquid whose viscosity is out of a range suitable to emit the liquid droplets upon recording can be emitted and removed to the outside of the liquid channel ICH.

Further, the number of emission times in the preliminary emitting process can be varied in accordance with the environmental conditions at that time, thereby enabling the process to be efficiently executed.

Figure 20:
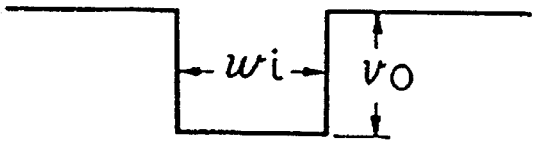
FIG. 20 is a waveform diagram for explaining a print output signal which is supplied to the head unit.

FIG. 20 shows an electrical signal which is applied to the emitting heater ET. In this diagram, $V_0$ denotes a voltage and $w_i$ is a pulse width. When the signal is supplied to the emitting heater ET in the preheating process, if bubbles are produced due to the heating, there might have occurred the case where the subsequent emission of liquid droplets becomes unstable or no droplet is emitted in the worst case. Therefore, the electrical signal which is applied to the emitting heater ET upon preheating must lie within a range such as not to produce any bubble on the emitting heater ET.

On the other hand, since those preheating processes are set when the power supply of the printer is turned on and when the printing is started, the preheating is fairly frequently executed. Therefore, the deterioration in durability of the emitting heater ET due to those preheating processes must be avoided. The inventors of this application have studied the durability of the emitting heater ET when an electric power (W) which is applied to the emitting heater ET was kept constant and the pulse width $w_i$ and applied voltage $v_0$ in the preheating processes using the emitting heater ET were changed. Thus, it was confirmed that the durability of the heater ET is improved as the pulse width $w_i$ and applied voltage $v_0$ are small.

On the other hand, the time required to heat the head unit HU to a desired temperature is determined by the electric power (W) which is applied to the emitting heater ET. However, as the actual performance of the recording apparatus, it is desirable that the time needed until the printing is started, namely, the waiting time is as short as possible.

In spite of such a purpose, it is undesirable to thoughtlessly increase the voltage which is applied to the emitting heater ET in terms of the durability of the heater as mentioned above. Further, since the production of a bubble on the emitting heater ET upon preheating causes the subsequent defective printing state or non-emission, it is difficult to increase the pulse width as well.

Therefore, to raise the temperature of the head unit to a desired temperature for a short time and within a range such that the preheating processes do not influence the durability of the emitting heater ET and no bubble is produced on the heater, it is effective to increase the frequency of the electrical signal which is supplied to the emitting heater ET.

Figure 21:
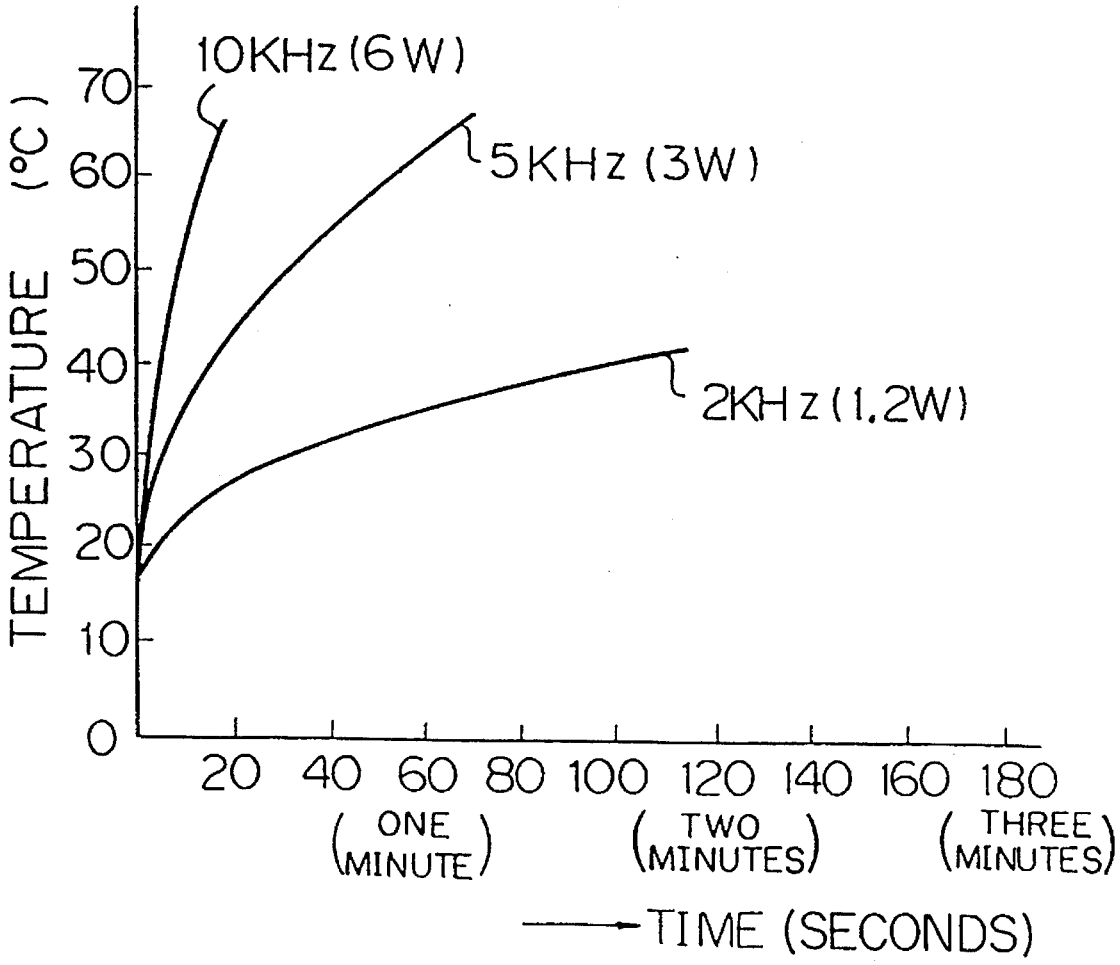
FIG. 21 is a graph of characteristic curves showing the relation between the supply time and the temperature in which a frequency of the print output signal which is supplied to the head unit is used as a parameter.

FIG. 21 shows an example of the relation between the time (minute) and the head temperature (°C.), in which the frequency of the preheating signal which is applied to the emitting heater ET is used as a parameter. In this example, the applied voltage $v_0$ was set to 24 V, the pulse width $w_i$ was set to 5 μsec and the frequency was set to 10 kHz, 5 kHz, and 2 kHz. The head temperature was detected by the temperature sensor TS.

The applicant of this application has performed the following two experiments by changing the voltage, pulse width, and frequency from the viewpoints mentioned above.

(Example 1)

The ink-jet printer according to the embodiment having the nozzle unit NZ as shown in FIG. 15B in which twenty-four orifices (a diameter of each orifice is 50×40 μrim) are vertically arranged in a line at regular intervals of 0.141 mm was used. The recording apparatus was filled with the recording liquid having compositions similar to the above. The electrical signal was supplied to the emitting heater ET under the conditions as shown in Table 2 and the preheating was performed.

Presence and absence of production of bubbles were checked by observing on the heater using an optical microscope. The result is shown in Table 2.

TABLE 2

| Applying conditions when recording | | | | |
|---|---|---|---|---|
| Voltage | Frequency | | Pulse width | |
| 24V | 2 kHz | | 10 μs | |
| **Applying conditions when preheating** | | | | |
| Voltage | Frequency | Pulse width | Applying time | Production of bubbles on the heater |
| 26V | 3.7 kHz | 5.0 μs | 15s | Bubbles were produced |
| 24V | 2.7 kHz | 7.5 μs | 15s | Bubbles were produced |
| 24V | 10 kHz | 2.0 μs | 15s | No bubble |
| 15V | 5.0 kHz | 10 μs | 15s | No bubble |
| 10V | 11.6 kHz | 10 μs | 15s | No bubble |

(These conditions are determined by setting the electric power consumption constant.)

(Example 2)

The ink-jet printer similar to (Example 1) was used and the recording apparatus was filled with the recording liquid containing the foregoing compositions. The signal was applied to the emitting heater ET under the conditions as shown in Table 3. The preheating processes were repeated to examine the durability of the heater ET. The result is shown in Table 3.

TABLE 3

| Preheating | | | | | |
|---|---|---|---|---|---|
| Voltage | Frequency | Pulse width | Applying time | Number of repetition times | Number of disconnection of the heater |
| 24V | 10 kHz | 2.0 μs | 15 sec | $10^5$ | Nil |
| 15V | 5.0 kHz | 10 μs | " | " | Nil |
| 10V | 11.6 kHz | 10 μs | " | " | Nil |

It will be understood from Table 3 that the pulse width of the electrical signal which is supplied to the emitting heater ET in the preheating processes is preferably set to be smaller than that of the electrical signal upon recording. As the result of further detailed experiments by the present applicant, it has been found that it is desired to set the pulse width to be a width within a range of 1 to 1/20 of the pulse width upon recording.

In addition, it will be appreciated that it is preferable to set the applied voltage of the electrical signal which is supplied to the emitting heater ET in the preheating processes to be equal or lower than the applied voltage upon recording.

Moreover, by setting the frequency of the electrical signal in the preheating processes to be higher than that upon recording, the time required for heating can be reduced.

Those parameters and the number of pulses can be very easily set by using the controller 10 as mentioned above.

The emission condition in the preliminary emitting processes will then be explained.

In the case where the recording has been interrupted or stopped for a long time, the viscosity of the ink remaining in and near the orifices OR increases due to the evaporation of the water and volatile organic solvent and the like, so that the ink is less likely to be emitted. Although the viscosity of the residual ink can be reduced due to the above-mentioned preheating processes, its viscosity is higher than the ink fitted for recording and the sizes, speeds, and the like of the liquid droplets differ and this residual ink is improper for recording. Therefore, in this embodiment, the preliminary emission is carried out subsequent to the preheating.

Upon preliminary emitting processes, the ink is not always emitted in response to the first pulse of the signal which is applied to the emitting heater ET at that time. Therefore, by increasing the energy of the signal upon preliminary emission than the energy of the signal upon printing and by varying the emitting time in accordance with the environmental conditions, the time required for the preliminary emission can be reduced and a high efficient emission can be realized.

The increase in the energy of the signal upon preliminary emission may be accomplished by practically increasing the voltage and/or pulse width than those upon recording. Namely, assuming that the voltage and pulse width of the signal which is applied to the emitting heater ET upon printing are respectively 24 V and 10 μsec, the voltage and/or pulse width of the signal upon preliminary emission may be set to be larger than those values. According to the experiments by the present applicant, the good result was obtained when the voltage was set to be one to five times, preferably, one to two times larger than that upon printing and the pulse width was likewise set to be one to five times, preferably, one to two times larger than that upon printing.

With respect to the emitting time, it is desirable to set the number of emission times, namely, the number of pulses in accordance with the environmental conditions. According to the experiments by the present applicant, in the preliminary emission (steps SJ subsequent to step S6 in FIG. 17A) before the start of the printing after the turn-on of the power supply, when 100 to 150 pulses were applied to the emitting heater ET, a good printing quality could be derived after that. After the start of the printing, the viscosity of the ink is high at low temperatures and the emission is more difficult to become stable as compared with the case at high temperatures; therefore, it is preferable to properly set the number of ink emission times. According to the experiments by the present applicant, in the preliminary emission when the lower temperature is more than the constant temperature (e.g., 20° C.) (when YES in step S11 in FIG. 17A), it has been confirmed that the stable emission was obtained when 20 to 50 pulses were applied to the emitting heater ET. On the contrary, in the preliminary emission when the lower temperature is lower than the constant temperature (when NO in step S11), the stable emission was derived when 50 to 100 pulses were applied to the heater ET.

The emission conditions in those preliminary emitting processes can be also easily set by using the controller 10 upon processing. The processes can be properly executed at a high speed without increasing the burden of the MPU 2.

On the other hand, if the region where the printer according to this embodiment is used is limited and is preliminarily and clearly known, the number of emission times can be also changed for every region. For example, in the region at a high temperature and at a low humidity, the temperature is always high and the ink is remarkably dried. Therefore, an amount of preliminary emission on the upper temperature side is increased relative to that on the lower temperature side to stabilize the emission of the ink. Also, by changing the above-mentioned numeric values of the number of emission times, the stable ink emission can be derived.

Although the ink-jet printer of the type in which the head unit is mounted on the carriage has been described in this embodiment, the present invention is not limited to this but may be apparently applied to the ink-jet printer of what is called a full-multi type in which a plurality of head units are arranged in the direction of width of the recording paper.

In addition, the respective parameters in the preheating processes and the respective parameters and the number of emission times in the preliminary emitting processes have been set in accordance with the temperature condition as mentioned in the embodiment. However, the invention is not limited to this method but can be also applied to the method whereby, for example, those parameters and the number of emission times are set in accordance with the environmental conditions such as humidity, pressure, or the like.

Moreover, although the electrothermal energy converting device was used as the emission energy generating means in this embodiment, for example, a piezoelectric element may be used.

As described above, according to the present invention, before the start of the printing after the turn-on of the power supply, the proper emission condition is set to the head-unit controller and the preliminary emitting processes are performed. Therefore, there is an effect such that it is possible to realize a liquid-discharge recording apparatus in which the software can be simplified and the printing state can be promptly and easily optimized.

In addition, the invention also has an effect such that the emission condition can be easily changed.

What is claimed is:

1. A liquid-discharge recording apparatus for emitting a liquid for recording on a recording medium in response to input printing data, said apparatus comprising:

a recording unit having emission energy generating means including an electrothermal energy generating device for heating a liquid according to an electrical signal so that a liquid droplet can be formed;

a microprocessing unit for processing the input printing data according to a program stored in a memory for outputting to said recording unit a recording signal for liquid emission, said microprocessing unit operable in a heating control mode and a recording control mode; and a controller, coupled between said microprocessing unit and said recording unit, operable with a set electrical signal condition, for supplying said emission energy generating means with the electrical signal having the set electrical signal condition, thereby controlling heating of said emission energy generating means, wherein said microprocessing unit sets, in the heating control mode, within said controller, a condition for a limit wherein a liquid droplet is not formed, so that said controller controls preliminary heating, and said microprocessing unit sets, in the recording control mode, a condition for recording, within said controller, so that said controller controls an emission for recording.

2. An apparatus according to claim 1, wherein said microprocessing unit effects setting for the heating control mode according to an environmental condition.

3. An apparatus according to claim 1, wherein said microprocessing unit effects setting for the heating control mode at an initiation of a power supplying to said apparatus.

4. An apparatus according to claim 1, wherein said microprocessing unit sets, for the heating control mode, within said controller, a pulse width of the electrical signal within a limit wherein a liquid droplet is not formed, so that said controller performs heating of the liquid.

5. An apparatus according to claim 1, wherein said recording unit includes a heater for controlling a temperature of the liquid independent of said emission energy generating means, and said microprocessing unit controls said controller to effect heating of the liquid in the heating mode, with said heater.

6. An apparatus according to claim 1, wherein said microprocessing unit sets in an emission control mode, within said controller, the electric signal with a condition for forming a liquid droplet, so that the liquid droplet is preliminarily emitted from said recording unit.

7. An apparatus according to claim 6, wherein said microprocessing unit effects the heating control mode at an initiation of power supplying, and then effects the emission control mode.

8. An apparatus according to claim 6 wherein said microprocessing unit effects the heating control mode at an initiation of recording, effects the emission control mode, and then effects a recording control mode.

9. An apparatus according to claim 6, wherein said microprocessing unit effects the heating control mode, and, after a predetermined time of waiting, effects the emission control mode.

10. An apparatus according to claim 1, further comprising feeding means for feeding the recording medium.

11. An apparatus according to claim 1, further comprising scanning means for scanning said recording unit.

12. A liquid-discharge recording method for emitting a liquid for recording on a recording medium in response to input printing data, said method comprising the steps of:

providing a recording unit having an emission energy generating means including an electrothermal energy generating device for heating a liquid according to an electrical signal;

providing a microprocessing unit for processing the input printing data according to a program stored in a memory for outputting to the recording unit a recording signal for liquid emission;

providing a controller, coupled between the microprocessing unit and the recording unit, operable with a set electrical signal condition, for supplying the emission energy generating means with the electrical signal having the set electrical signal condition, thereby controlling heating of the emission energy generating means;

operating the microprocessing unit to set the controller at a condition for a limit wherein a liquid droplet is not formed, so as to preliminarily heat the liquid; and operating the microprocessing unit to set a condition for recording at the controller, so as to emit the liquid for recording from the recording unit.

13. A liquid-discharge recording apparatus for emitting liquid droplets for recording on a recording medium, said apparatus comprising:

a recording unit having energy generating means for applying energy to a liquid according to electrical signals so that a liquid droplet can be formed, each electrical signal being characterized by a frequency;

heating control means for heating the liquid in said recording unit;

recording control means for supplying said recording unit with an electrical signal based on a recording signal for liquid droplet emission from said recording unit; and emission control means, coupled to said recording unit, for supplying said recording unit with an electrical signal with a frequency lower than that of the electrical signal supplied by said recording control means so that said recording unit emits the liquid droplet preliminary to recording, after said heating control means heats the liquid in said recording unit.

14. An apparatus according to claim 13, wherein said energy generating means includes an electrothermal conversion device capable of heating the liquid according to the electrical signals for forming the liquid droplet.

15. An apparatus according to claim 13, further comprising feeding means for feeding the recording medium.

16. An apparatus according to claim 13, further comprising scanning means for scanning said recording unit.

17. A liquid-discharge recording method for emitting liquid droplets for recording on a recording medium, said method comprising the steps of:

providing a recording unit having energy generating means for applying energy to a liquid according to electrical signals, each electrical signal being characterized by a frequency;

heating the liquid in the recording unit;

supplying the recording unit with an electrical signal for liquid droplet preliminary emission after said heating step; and thereafter, supplying the recording unit with an electrical signal based on a recording signal for liquid droplet emission from the recording unit, wherein the frequency of the electrical signal supplied for the preliminary emission is lower than the frequency of the electrical signal applied for the recording emission.

18. A method according to claim 17, wherein the energy generating means includes an electrothermal conversion device capable of heating the liquid according to the electrical signals for forming the liquid droplet.

19. A method according to claim 17, wherein in said heating step the energy generating means is supplied with an electrical signal within a limit such that a liquid droplet is not formed, thereby heating the liquid in the recording unit.

* * * * *

UNITED STATES PATENT AND TRADEMARK OFFICE

CERTIFICATE OF CORRECTION

PATENT NO. : 5,548,308 Page 1 of 2

DATED : August 20, 1996

INVENTOR(S) : Akira NAGATOMO, et al.

It is certified that error appears in the above-indentified patent and that said Letters Patent is hereby corrected as shown below:

ON THE TITLE PAGE:

AT [57] - ABSTRACT:

Line 15, "and" should be deleted.

COLUMN 9:

Line 12, "flight" should be deleted;
Line 32, "flight" should be deleted.

COLUMN 15:

Line 9, "S44)." should read --S44)--.

COLUMN 17:

Line 40, "μrim)" should read --μm)--.

UNITED STATES PATENT AND TRADEMARK OFFICE

CERTIFICATE OF CORRECTION

PATENT NO. : 5,548,308 Page 2 of 2

DATED : August 20, 1996

INVENTOR(S) : Akira NAGATOMO, et al.

It is certified that error appears in the above-indentified patent and that said Letters Patent is hereby corrected as shown below:

COLUMN 20:

Line 66, "claim 6" should read --claim 6,--.

Signed and Sealed this

Eighteenth Day of March, 1997

Bruce Lehman

*Attest:*

BRUCE LEHMAN

*Attesting Officer*

*Commissioner of Patents and Trademarks*